US009023573B2

(12) United States Patent
Kikushima

(10) Patent No.: US 9,023,573 B2
(45) Date of Patent: May 5, 2015

(54) TONER FOR ELECTROSTATIC-CHARGE IMAGE DEVELOPMENT AND METHOD FOR PRODUCING TONER FOR ELECTROSTATIC-CHARGE IMAGE DEVELOPMENT

(71) Applicant: KYOCERA Document Solutions Inc., Osaka-shi (JP)

(72) Inventor: Seiji Kikushima, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/013,839

(22) Filed: Aug. 29, 2013

(65) Prior Publication Data

US 2014/0065536 A1 Mar. 6, 2014

(30) Foreign Application Priority Data

Aug. 31, 2012 (JP) ..... 2012-191850

(51) Int. Cl.
*G03G 9/093* (2006.01)
*G03G 9/087* (2006.01)
*G03G 9/08* (2006.01)

(52) U.S. Cl.
CPC ..... *G03G 9/0804* (2013.01); *G03G 9/09307* (2013.01); *G03G 9/09321* (2013.01); *G03G 9/0935* (2013.01); *G03G 9/09357* (2013.01); *G03G 9/09392* (2013.01); *G03G 9/08755* (2013.01)

(58) Field of Classification Search
USPC ..... 430/137.11, 137.14
See application file for complete search history.

(56) References Cited

U.S. PATENT DOCUMENTS

| | | | |
|---|---|---|---|
| 5,334,480 | A | 8/1994 | Inaba et al. |
| 5,571,651 | A | 11/1996 | Inaba et al. |
| 7,553,600 | B2 | 6/2009 | Kawamura et al. |
| 2007/0072103 | A1 | 3/2007 | Kawamura et al. |
| 2010/0173240 | A1 | 7/2010 | Sensui |

FOREIGN PATENT DOCUMENTS

| | | | |
|---|---|---|---|
| JP | 2005-091813 | A | 7/2005 |
| JP | 2007-094041 | A | 4/2007 |
| JP | 2011-128575 | A | 6/2011 |
| JP | 2013-210458 | A | 10/2013 |
| WO | 2007/114502 | A | 11/2007 |

OTHER PUBLICATIONS

EESR issued to EP Application No. 13182184.5, mailed Dec. 3, 2013.

*Primary Examiner* — Hoa V Le
(74) *Attorney, Agent, or Firm* — Knobbe Martens Olson & Bear LLP

(57) ABSTRACT

A toner for electrostatic-charge image development contains toner particles in which the surfaces of core particles, including a binder resin composed of a polyester resin, are coated with shell layers. The shell layer is formed of a resin composed of a copolymer of monomers including a monomer having a quaternary ammonium group and a (meth)acrylic copolymer. The molar ratio of units derived from a monomer having a quaternary ammonium group is 5 mol % or more and 35 mol % or less.

4 Claims, 1 Drawing Sheet

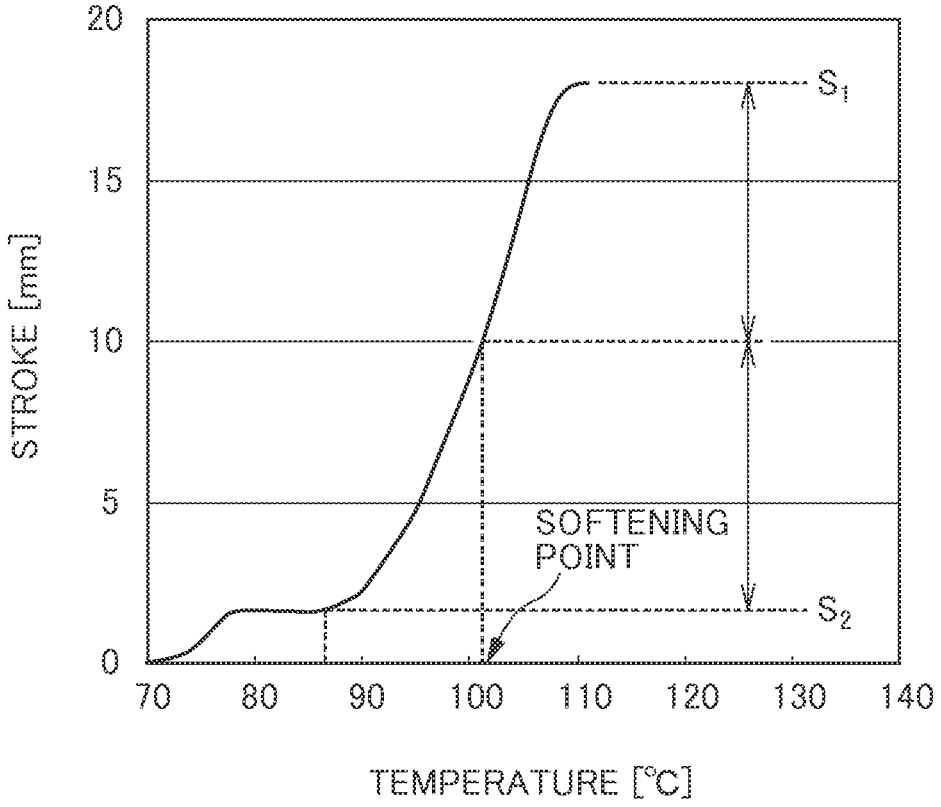
20
15
10
5
0
STROKE [mm]
70
80
90
100
110
120
130
140
TEMPERATURE [°C]
S1
S2
SOFTENING POINT

TONER FOR ELECTROSTATIC-CHARGE IMAGE DEVELOPMENT AND METHOD FOR PRODUCING TONER FOR ELECTROSTATIC-CHARGE IMAGE DEVELOPMENT

INCORPORATION BY REFERENCE

This application is based upon and claims the benefit of priority from the corresponding Japanese Patent Application No. 2012-191850, filed in the Japan Patent Office on Aug. 31, 2012, the entire contents of which are incorporated herein by reference.

FIELD

The present disclosure relates to a toner for electrostatic-charge image development and a method for producing a toner for electrostatic-charge image development.

BACKGROUND

In electrophotography, generally, a surface of an electrostatic latent image bearing member is charged by a method such as corona discharge, followed by exposure by means such as a laser to form an electrostatic latent image. The formed electrostatic latent image is then developed with a toner to form a toner image. The formed toner image is further transferred onto a recording medium to obtain an image with high quality. For forming the toner image, typically, The toner containing toner particles (toner base particles) with an average particle diameter of from 5 μm to 10 μm are used, which are obtained by mixing a binder resin, such as a thermoplastic resin, with toner components such as a colorant, a charge control agent, a release agent, and then by subjecting the mixture to a kneading step, a pulverizing step, and a classifying step. In order to provide flowability and preferable electrostatic properties to the toner particles and/or to provide easy cleaning ability of the toner particles from surfaces of photoconductor drums, silica and/or inorganic fine particles such as those of titanium oxide are externally added to the toner base particles.

Such a toner is desired to have excellent fixability at low temperatures, which can be properly fixed without heating a fixing roller as much as possible, in terms of saving energy and the minimization of devices. In the production of a toner having excellent fixability at low temperatures, however, binder resins having a low melting point or a low glass transition point, or release agents having a low melting point are often used. For that reason, there are disadvantages in which toner particles in the toner are easily agglomerated when it is stored at a high temperature.

If toner particles agglomerate, an image failure may occur as a result of adhesion of toner particles onto a developing sleeve or a photoconductor drum, or fogging may occur in the formed image as a result of charge failure of toner particles when an image is formed by using a toner containing agglomerated toner particles. If toner particles agglomerate, the charge characteristics of the agglomerated toner particles change in comparison with other toner particles that are not agglomerated. In this case, agglomerated toner particles may adhere to a location that is not related to the image to be output, leading to color spot in the fixed output image.

To cope with the problem described above, a toner composed of toner particles having a core-shell structure in which core particles including a binder resin having a low melting point are coated with shell layers composed of a resin having a glass transition point (Tg) higher than that of the binder resin included in the core particles is used to improve fixability in wide range of temperatures, to improve storage stability at high temperatures and to improve blocking resistance.

The following toner particles have been proposed as toner particles having the core-shell structure as described below. The toner particles are toner particles with an amino group-containing compound attached as an external additive on the surfaces of toner base particles. The toner base particles are formed in the following manner. First, emulsified and dispersed fine particles of a binder resin and colorant fine particles are aggregated in an aqueous medium, followed by fusing of the fine particles together to form core particles. Then, fine particles of a positively chargeable charge-control resin containing quaternary ammonium salt-containing acrylate units, which are emulsified and dispersed, are added to the aqueous medium containing core particles. Thereafter, the positively chargeable charge-control resin fine particles are fused to the surfaces of the core particles to form shell layers, thereby obtaining toner base particles.

The above-described toner particles have shell layers composed of positively chargeable charge-control resin fine particles and an external additive that is an amino group-containing compound, and therefore when an image is formed by using the toner particles, the toner particles are charged at a desired charge value to suppress fogging in the formed image. However, when the above-described toner particles are used, the external additive may be embedded in toner base particles or detached from toner base particles if printing is carried out at a low coverage rate for a long time and toner particles are stirred in a developing unit for a long time. Consequently, toner particles may not be charged at the desired charge value. In this case, it is difficult to suppress fogging in the formed image.

In the above-described toner particles, the molar ratio of quaternary ammonium salt-containing acrylate units in the resin forming shell layers is only about 1%, and therefore toner particles may not be charged to a desired charge level in a short time, depending on the state of formation of the shell layers. In this case, color spot or fogging tends to occur in the formed image.

SUMMARY

A toner for electrostatic-charge image development according to a first aspect of the present disclosure includes:

Toner particles in which the surfaces of core particles including a binder resin composed of a polyester resin are coated with shell layers. A shell layer is a resin composed of a copolymer of monomers including a monomer having a quaternary ammonium group and a (meth)acrylic monomer. The molar ratio of units derived from the monomer having a quaternary ammonium group in the copolymer is 5 mol % by mass or more and 35 mol % by mass or less.

A method for producing a toner for electrostatic-charge image development according to another aspect of the present disclosure is a method for producing toner particles contained in a toner for electrostatic-charge image development in which the surfaces of core particles including a binder resin composed of a polyester resin are coated with shell layers, the method including steps (I) to (IV). Step (I) is a core particle dispersion-preparing step of obtaining an aqueous dispersion (1) containing core particles including a binder resin composed of a polyester resin, where aqueous dispersion (1) contains an anionic or nonionic dispersant. Step (II) is a mixing step of mixing aqueous dispersion (1) adjusted to a pH of 5 or less and an aqueous dispersion (2) containing resin fine particles to obtain an aqueous dispersion (3) containing the core particles and the resin fine particles. Step (III) is a coating step of adjusting the pH of aqueous dispersion (3) to 6 or more and 10 or less, followed by heating aqueous dispersion (3) to coat the surfaces of the core particles with the resin fine particles, thereby obtaining an aqueous dispersion (4) containing core particles coated with resin fine particles. Step (IV) is a film-forming step of adjusting the pH of aqueous dispersion (4) to 5 or less, followed by heating of aqueous dispersion (4) to transform the resin fine particles, with which the surfaces of the core particles are coated, into a film. The shell layer is a resin composed of a copolymer of monomers including a monomer having a quaternary ammonium group and a (meth)acrylic monomer. The molar ratio of units derived from the monomer having a quaternary ammonium group in the copolymer is 5 mol % or more and 35 mol % or less.

BRIEF DESCRIPTION OF DRAWINGS

FIG. 1 is a view explaining a method for measuring the softening point by using an elevated flow tester.

DETAILED DESCRIPTION

The present disclosure is explained in detail with respect to embodiments thereof below; however, the present disclosure is not limited at all to the embodiments and may be carried out with appropriately making a change within the purpose of the present disclosure.

In addition, explanation may be occasionally omitted with respect to duplicated matters; this does not however limit the gist of the present disclosure.

First Embodiment

The first embodiment of the present disclosure relates to a toner for electrostatic-charge image development (hereinafter, also referred to as a toner). The toner for electrostatic-charge image development according to the first embodiment includes toner particles in which the surfaces of core particles including a binder resin composed of a polyester resin are coated with shell layers. The shell layer is composed of a resin that is a copolymer of monomers including a monomer having a quaternary ammonium group and a (meth)acrylic monomer. The molar ratio of units derived from the monomer having a quaternary ammonium group in the copolymer is 5 mol % or more and 35 mol % or less. The toner of the present disclosure is composed of toner particles, but may include other components.

The core particles may include components such as a colorant, a release agent, a charge-control agent, and a magnetic powder in the binder resin as required. An external additive may be further attached on the surface of the toner particle. The toner may also be mixed with a desired carrier and used as a two-component developer. The core particle, the shell layer, the external additive, and the carrier used when the toner is employed as a two-component developer are explained in order below.

Core Particles

The core particle essentially includes a binder resin. The core particle may include components such as a colorant, a release agent, a charge-control agent, and a magnetic powder in the binder resin as required. For the core particle of the toner of the first embodiment of the present disclosure, the binder resin, the colorant, the release agent, the charge-control agent, and the magnetic powder, which are essential or optional components, are explained in order below.

[Binder Resin]

The core particle essentially includes a binder resin composed of a polyester resin. By using a polyester resin as the binder resin, a toner, which can be properly fixed at a low temperature and has excellent chromogenics, is easily prepared. The polyester resin to be used as the binder resin may be appropriately selected from polyester resins used heretofore as binder resins for toners. As the polyester resin, one obtained by condensation polymerization or condensation copolymerization of an alcohol component and a carboxylic acid component may be used. Examples of the component to be used when the polyester resin is synthesized include the following divalent, trivalent, or higher-valent alcohol components and divalent, trivalent, or higher-valent carboxylic acid components.

Specific examples of the divalent, trivalent or higher-valent alcohols may be exemplified by diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and trivalent or higher-valent alcohols such as sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent, trivalent or higher-valent carboxylic acids include divalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azealic acid, malonic acid, or alkyl or alkenyl succinic acids including n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher-valent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra (methylenecarboxyl)methane, 1,2,7,8-octanetetracarboxylic acid, pyromellitic acid, and Enpol trimer. These divalent, trivalent or higher-valent carboxylic acids may be used as ester-forming derivatives such as an acid halide, an acid anhydride, and a lower alkyl ester. Here, the term "lower alkyl" means an alkyl group of 1 carbon atoms or more and 6 carbon atoms or less.

The acid value of the polyester resin is preferably 5 mg KOH/g or more and 30 mg KOH/g or less. When core particles are prepared by using a polyester resin having an excessively low acid value, aggregation of fine particles may proceed only with difficulty when core particles are produced by a method of aggregating fine particles. A toner composed of toner particles including as the binder resin a polyester resin having an excessively high acid value tends to undergo degradation of various properties under the influence of humidity in a high-humidity environment.

Among polyester resins, amorphous polyester resins are preferred because a toner with excellent fixability at low temperatures is easily obtained. The amorphous polyester resin is explained below.

(Amorphous Polyester Resin)

The above-described divalent, trivalent, or higher-valent alcohol components and divalent, trivalent, or higher-valent carboxylic acid components may be used as monomers for the synthesis of an amorphous polyester resin. In the description and claims of the present application, the amorphous polyester resin is a polyester resin having a crystallinity index of 1.20 or more, preferably 1.50 or more and 3.00 or less. The crystallinity index of the amorphous polyester resin can be adjusted by appropriately adjusting the types and the amounts of alcohol components and carboxylic acid components used as monomers.

The crystallinity index of the polyester resin can be determined from the ratio of the softening point and the peak temperature of the heat of fusion (softening point/peak temperature of heat of fusion) of the polyester resin. The softening point of the polyester resin is measured with the flow tester described later, and the peak temperature of the heat of fusion is measured with the differential scanning calorimeter (DSC) described later.

When an amorphous polyester resin is prepared, crystallization of the polyester resin obtained must be suppressed. Examples of the method for suppressing crystallization of the polyester resin include the following methods 1) to 3).

1) An alcohol component and a carboxylic acid component that promote crystallization are used only in small amounts or are not used at all.

2) Two or more compounds each are used as the alcohol component and as the carboxylic acid component.

3) Crystallization is suppressed by using a monomer capable of suppressing crystallization, such as an alkylene oxide adduct of bisphenol A or an alkyl-substituted succinic acid.

Examples of an alcohol component that readily promotes crystallization of the polyester resin include aliphatic diols having 2 carbon atoms or more and 8 carbon atoms or less. Among aliphatic diols, α,ω-alkanediols having 2 carbon atoms or more and 8 carbon atoms or less in particular readily promote crystallization. Examples of the carboxylic acid component that readily promotes crystallization of the polyester resin include aliphatic dicarboxylic acids having 2 carbon atoms or more and 16 carbon atoms or less. Among aliphatic dicarboxylic acids, particularly α,ω-alkane dicarboxylic acids having 2 carbon atoms or more and 16 carbon atoms or less readily promote crystallization.

Among the above-described methods for suppression of crystallization, method 3 is more preferred because the number of types of monomers is small and preparation of an amorphous polyester resin is easy. In method 3, suppression of crystallization becomes easier with increasing amounts of the alkylene oxide adduct of bisphenol A and the alkyl-substituted succinic acid used. The amounts of these monomers used are appropriately adjusted in consideration of crystallization and other physical properties of the polyester resin obtained.

A single polyester resin may be used, or two or more polyester resins may be combined and used.

The softening point of the polyester resin is preferably 60° C. or more and 100° C. or less, and more preferably 70° C. or more and 95° C. or less. When an image is formed by using a toner composed of toner particles including a polyester resin having an excessively high softening point, adhesion of toner particles onto the developing sleeve is suppressed, but the toner may be hard to fix properly at low temperatures. A toner composed of toner particles including a polyester resin having an excessively low softening point may have inferior heat-resistant storage stability, and adhesion of toner particles onto the developing sleeve may occur when an image is formed by using the toner. The softening point of the polyester resin can be measured by the following method.

Method of Measuring Softening Point

The softening point of the polyester resin (toner) is measured using an elevated flow tester (CFT-500D, manufactured by Shimadzu Corporation). A polyester resin of 1.5 g is used as a sample, and a die of 1.00 mm height and 1.00 mm diameter is used. Measurement is performed under conditions of a temperature-raising rate 4° C./min, pre-heat time 300 seconds, load 5 kg, and measuring temperature range from 60° C. to 200° C. The softening point of the polyester resin can be read from a S-shaped curve that is obtained from the measurement using the flow tester and that shows a relationship between temperature (° C.) and stroke (mm).

The way to read the softening point is explained with reference to FIG. 1. A maximum stroke value is defined as $S_1$, and a base line stroke value on the lower temperature side is defined as $S_2$. The temperature at which the stroke value is $(S_1+S_2)/2$ on the S-shaped curve is defined as the softening point of the polyester resin.

The glass transition point (Tgd of the polyester resin is preferably 30° C. or more and 60° C. or less, and more preferably 35° C. or more and 55° C. or less. Toner particles including a polyester resin having an excessively low $Tg_1$ may have low strength and may tend to agglomerate in a high-temperature and high-humidity environment. When an image is formed by using a toner composed of toner particles including a polyester resin having an excessively high $Tg_1$, the toner may be hard to fix properly at low temperatures. The glass transition point of the polyester resin can be measured by the following method.

Method for Measurement of Glass Transition Point

The glass transition point of the polyester resin can be determined from the point of change in the specific heat of the polyester resin by using a differential scanning calorimeter (DSC). More specifically, the glass transition point of the polyester resin can be determined by measuring the endothermic curve of the polyester resin by using as a measuring device a DSC-6200 differential scanning calorimeter manufactured by Seiko Instruments Inc. 10 mg of the sample to be measured is loaded into an aluminum pan, and an empty aluminum pan is used as a reference. The glass transition point of the polyester resin can be determined from the endothermic curve of the polyester resin, which is obtained by performing a measurement at normal temperature and normal humidity under measuring conditions of a measuring temperature range of from 25° C. to 200° C. and a rate of temperature raising of 10° C./minute.

The number-average molecular mass (Mn) of the polyester resin is preferably 1,500 or more and 5,000 or less. The molecular mass distribution (Mw/Mn), expressed as the ratio of the mass-average molecular mass (Mw) to the number-average molecular mass (Mn), is preferably 2 or more and 100 or less. By producing toner particles by using a polyester resin whose molecular-mass distribution falls within the above-mentioned range, occurrence of offset is easily suppressed, so that it is easy to obtain a toner with a wide temperature range in which offset does not occur. The number-average molecular mass (Mn) and the mass-average molecular mass (Mw) of the polyester resin can be measured by gel permeation chromatography.

[Colorant]

Core particles may include a colorant as required. Known pigments and dyes may be used as the colorant to be included in core particles, depending on the color of the toner particles. Specific examples of the preferred colorant that may be included in core particles include the following colorants.

Black colorants may include carbon black. As the black colorant, a colorant obtained by color-mixing of a yellow colorant, a magenta colorant and a cyan colorant described below, may be utilized. When the toner is a color toner, examples of the colorant to be compounded in core particles include yellow colorants, magenta colorants, and cyan colorants.

Yellow colorants may be exemplified by those of condensed azo compounds, isoindolinone compounds, anthraquinone compounds, azo metal complexes, methine compounds, and allylamide compounds. Yellow colorants may specifically be exemplified by C.I. pigment yellows 3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194; Naphthol Yellow S, Hansa Yellow G, and C.I. Vat Yellow.

Magenta colorants may be exemplified by those of condensed azo compounds, diketo-pyrrolo-pyrrole compounds, anthraquinone compounds, quinacridone compounds, basic dye lake compounds, naphthol compounds, benzimidazolone compounds, thioindigo compounds, and perylene compounds. Magenta colorants may specifically be exemplified by C.I. pigment reds 2, 3, 5, 6, 7, 19, 23, 48:2, 48:3, 48:4, 57:1, 81:1, 122, 144, 146, 150, 166, 169, 177, 184, 185, 202, 206, 220, 221, and 254.

Cyan colorants may be exemplified by those of copper phthalocyanine compounds, copper phthalocyanine derivatives, anthraquinone compounds, and basic dye lake compounds. Cyan colorants may specifically be exemplified by C.I. pigment blues 1, 7, 15, 15:1, 15:2, 15:3, 15:4, 60, 62, and 66, Phthalocyanine Blue, C.I. Vat Blue, and C.I. Acid Blue.

The amount of the colorant used is preferably 1% by mass or more and 20% by mass or less, and more preferably 3% by mass or more and 10% by mass or less based on the mass of the toner.

[Release Agent]

The core particle may include a release agent as required. The release agent is usually used for the purpose of improving the fixability and offset resistance of the toner. The release agent is not particularly limited as long as it has been used heretofore as a release agent for a toner.

Preferable release agents may include aliphatic hydrocarbon waxes such as low molecular mass polyethylene, low molecular mass polypropylene, polyolefin copolymer, polyolefin wax, microcrystalline wax, paraffin wax, and Fischer-Tropsch wax; oxides of aliphatic hydrocarbon wax such as oxidized polyethylene wax and block copolymer of oxidized polyethylene wax; vegetable waxes such as candelilla wax, carnauba wax, Japan wax, jojoba wax, and rice wax; animal waxes such as bees wax, lanolin, and whale wax; mineral waxes such as ozokerite, ceresin, and petrolatum; waxes containing a fatty acid ester as a main component such as montanate ester wax and castor wax; and waxes obtained by deoxidization of a part or whole of fatty acid ester such as deoxidized carnauba wax.

The release agent, which can be preferably used, may further include saturated straight-chain fatty acids such as palmitic acid, stearic acid, montanic acid, and long-chain alkyl carboxylic acids having a long-chain alkyl group; unsaturated fatty acids such as brassidic acid, eleostearic acid, and valinaphosphoric acid; saturated alcohols such as stearyl alcohol, eicosyl alcohol, behenyl alcohol, Cal Now building alcohol, ceryl alcohol, mericyl alcohol, and long-chain alkyl alcohols having a long-chain alkyl group; polyhydric alcohols such as sorbitol; fatty acid amides such as linoleic acid amide, oleic acid amide, and lauric acid amide; saturated fatty acid bisamides such as methylenebisstearic acid amide, ethylenebiscapric acid amide, ethylenebislauric acid amide, and hexamethylenebisstearic acid amide; unsaturated fatty acid amides such as ethylenebisoleic acid amide, hexamethylenebisoleic acid amide, N,N'-dioleyladipic acid amide, N,N'-dioleylsebacic acid amide, and aromatic bisamides such as m-xylenebisstearic acid amide, and N,N'-distearyl isophthalic acid amide; fatty acid metal salts such as calcium stearate, calcium laurate, zinc stearate, and magnesium stearate; waxes in which a vinyl monomer such as styrene or acrylic acid is grafted onto an aliphatic hydrocarbon wax; partial esterized compound of a fatty acid and a polyhydric alcohol such as monoglyceride of behenic acid; and methyl ester compounds having a hydroxyl group obtained by hydrogenation of a vegetable fat and oil.

The amount of the release agent used is preferably 1 part by mass or more and 30 parts by mass or less, and more preferably 5 parts by mass or more and 20 parts by mass or less based on 100 parts by mass of the binder resin. When a toner composed of toner particles having an excessively small amount of the release agent is used, the desired effect may not be achieved for suppression of offset and image smearing in the formed image. When core particles are prepared by using an excessively large amount of the release agent, toner particles may tend to be fused together, resulting in a toner having low storage stability.

[Charge-Control Agent]

The core particle may include a charge-control agent as required. The charge-control agent is used to obtain a toner with excellent durability and stability by improving the charge-level stability of toner particles or the charge-increasing property, which gives an indication as to whether or not toner particles can be charged to a predetermined charge level within a short time.

The charge control agent may be appropriately selected from conventional charge control agents used for toners heretofore. Specific examples of the positively chargeable charge control agent are azine compounds such as pyridazine, pyrimidine, pyrazine, ortho-oxazine, meta-oxazine, para-oxazine, ortho-thazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes consisting of azine compounds such as azine FastRed FC, azine FastRed 12BK, azine Violet BO, azine Brown 3G, azine Light Brown GR, azine Dark Green BH/C, azine Deep Black EW, and azine Deep Black 3RL; nigrosine compounds such as nigrosine, nigrosine salts, and nigrosine derivatives; acid dyes consisting of nigrosine compounds such as nigrosine BK, nigrosine NB, and nigrosine Z; metal salts of naphthenic acid or higher fatty acid; alkoxylated amines; alkylamides; quaternary ammonium salts such as benzylmethylhexyldecyl ammonium, and decyltrimethylammonium chloride. These positively chargeable charge control agents may be used in a combination of two or more.

Resins having a quaternary ammonium salt, a carboxylic acid salt, or a carboxyl group as a functional group may also be used as the positively chargeable charge control agent. More specifically, styrene resins having a quaternary ammonium salt, acrylic resins having a quaternary ammonium salt, styrene-acrylic resins having a quaternary ammonium salt, polyester resins having a quaternary ammonium salt, styrene resins having a carboxylic acid salt, acrylic resins having a carboxylic acid salt, styrene-acrylic resins having a carboxylic acid salt, polyester resins having a carboxylic acid salt, styrene resins having a carboxylic group, acrylic resins having a carboxylic group, styrene-acrylic resins having a carboxylic group, and polyester resins having a carboxylic group may be exemplified. These resins may be an oligomer or a polymer.

Among the resins usable as the positively chargeable charge control agent, styrene-acrylic resins having a quaternary ammonium salt as a functional group are more preferable since the charged amount may be easily controlled within a desired range. In regards to the styrene-acrylic resins having a quaternary ammonium salt as a functional group, preferable specific examples of acrylic comonomers copolymerized with a styrene unit are (meth)acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

The units derived from dialkylamino alkyl(meth)acrylates, dialkylamino (meth)acrylamides, or dialkylamino alkyl (meth)acrylamides through a quaternizing step may be used as the quaternary ammonium salt. Specific examples of the dialkylamino alkyl(meth)acrylate are dimethylamino ethyl (meth)acrylate, diethylamino ethyl(meth)acrylate, dipropylamino ethyl(meth)acrylate, and dibutylamino ethyl(meth) acrylate; a specific example of the dialkyl(meth)acrylamide is dimethyl methacrylamide; and a specific example of the dialkylamino alkyl(meth)acrylamide is dimethylamino propylmethacrylamide. Additionally, hydroxyl group-containing polymerizable monomers such as hydroxy ethyl(meth) acrylate, hydroxy propyl(meth)acrylate, 2-hydroxy butyl (meth)acrylate, and N-methylol (meth)acrylamide may also be used in combination at the time of polymerization.

The amount of the positively chargeable charge-control agent used is preferably 0.5 parts by mass or more and 20.0 parts by mass or less, more preferably 1.0 part by mass or more and 15.0 parts by mass or less based on 100 parts by mass of the total amount of toner. When an image is formed by using a toner composed of toner particles having an excessively low amount of charge-control agent, the toner has difficulty taking on a stable charge to a predetermined polarity, and therefore the image density of the formed image may be lower than a desired value, or it may be difficult to keep the image density at a desired value for a long period of time. In this case, it is hard to uniformly disperse the charge-control agent in the binder resin, so that fogging in the formed image, or smear of a latent image bearing member by toner components, tends to occur. When an image is formed by using a toner composed of toner particles having an excessively large amount of charge-control agent, image failure tends to occur in the formed image as a result of charge failure in a high-temperature and high-humidity environment, and smear of a latent image-bearing member by toner components tends to occur.

[Magnetic Powder]

The core particles may include a magnetic powder as required. Examples of the magnetic powder include irons such as ferrite and magnetite; ferromagnetic metals such as cobalt and nickel; alloys containing iron and/or a ferromagnetic metal; compounds containing iron and/or a ferromagnetic metal; ferromagnetic alloys subjected to ferromagnetizing treatment such as heat treatment; and chromium dioxide.

The particle diameter of the magnetic powder is preferably 0.1 μm or more and 1.0 μm or less, and more preferably 0.1 μm or more and 0.5 μm or less. When toner particles are prepared by using a magnetic powder having a particle diameter in the above-described range, the magnetic powder is easily uniformly dispersed in the binder resin.

When the toner is used as a one-component developer, the amount of the magnetic powder used is preferably 35 parts by mass or more and 60 parts by mass or less, and more preferably 40 parts by mass or more and 60 parts by mass or less, based on 100 parts by mass of the total amount of the toner. When an image is formed by using a toner composed of toner particles having an excessively large amount of the magnetic powder, it may be difficult to keep the image density at a desired value for a long period of time, or the toner may be extremely hard to fix. When an image is formed by using a toner composed of toner particles having an excessively small amount of the magnetic powder, fogging tends to occur in the formed image. When fogging occurs in the formed image, it may be difficult to keep the image density at a desired value for a long period of time. When the toner is used as a two-component developer, the amount of the magnetic powder used is preferably 20 parts by mass or less, more preferably 15 parts by mass or less, based on 100 parts by mass of the total amount of the toner.

Shell Layer

The shell layer is composed of a resin composed of a copolymer of monomers including a monomer having a quaternary ammonium group and a (meth)acrylic monomer. The molar ratio of units derived from the monomer having a quaternary ammonium group in the copolymer is 5 mol % or more and 35 mol % or less. Resins that form the shell layer are explained below.

The resins are preferably (meth)acrylic resins and styrene-(meth)acrylic resins because a toner excellent in heat-resistant storage stability is easily obtained. These resins may be used in combinations of two or more. The (meth)acrylic resin, the styrene-(meth)acrylic resin, and the monomer having a quaternary ammonium group are explained in order below.

[(Meth)Acrylic Resin]

The (meth)acrylic resin is a resin obtained by copolymerizing monomers including at least a monomer having a quaternary ammonium group and a (meth)acrylic monomer. Examples of the (meth)acrylic monomer include (meth) acrylic acid; alkyl (meth)acrylates such as methyl (meth) acrylate, ethyl (meth)acrylate, and propyl (meth)acrylate; and (meth)acrylamide compounds such as (meth)acrylamide, N-alkyl (meth)acrylamide, N-aryl (meth)acrylamide, N,N-dialkyl (meth)acrylamide, and N,N-diaryl (meth)acrylamide. Preferably the (meth)acrylic resin contains as an acid group a carboxyl group contained in a unit derived from (meth)acrylic acid. In this case, the acid value of the (meth)acrylic resin can be adjusted by increasing or decreasing the amount of (meth) acrylic acid used when the (meth)acrylic resin is prepared.

When the (meth)acrylic resin is a resin obtained by copolymerizing a (meth)acrylic monomer, a monomer having a quaternary ammonium group and a monomer other than the (meth)acrylic monomer and the monomer having a quaternary ammonium group, examples of the other monomer include olefins such as ethylene, propylene, butane-1, pentene-1, hexene-1, heptene-1, and octane-1; allyl esters such as allyl acetate, allyl benzoate, allyl acetoacetate, and allyl lactate; vinyl ethers such as hexyl vinyl ether, octyl vinyl ether, etylhexyl vinyl ether, methoxyethyl vinyl ether, ethoxyethyl vinyl ether, chloroethyl vinyl ether, 2-ethylbutyl vinyl ether, dimethylaminoethyl vinyl ether, diethylaminoethyl vinyl ether, benzyl vinyl ether, vinyl phenyl ether, vinyl tolyl ether, vinyl chlorophenyl ether, vinyl-2,4-dichlorophenyl ether, and vinyl naphthyl ether; and vinyl esters such as vinyl acetate, vinyl propionate, vinyl butylate, vinyl isobutylate, vinyl diethylacetate, vinyl chloroacetate, vinyl methoxyacetate, vinyl butoxyacetate, vinyl phenylacetate, vinyl acetoacetate, vinyl lactate, vinyl benzoate, vinyl salicylate, vinyl chlorobenzoate, and vinyl naphthoate.

When the resin that forms the shell layer is a (meth)acrylic resin, the content of units derived from the (meth)acrylic monomer contained in the (meth)acrylic resin is preferably 45% by mass or more, more preferably 55% by mass or more, especially preferably 65% by mass or more.

[Styrene-(Meth)Acrylic Resin]

The styrene-(meth)acrylic resin is a resin obtained by copolymerizing monomers including at least a monomer having a quaternary ammonium group, a styrene monomer, and a (meth)acrylic monomer.

Examples of the styrene monomer include styrene, α-methylstyrene, o-methylstyrene, m-methylstyrene, p-methylstyrene, p-ethylstyrene, 2,4-dimethylstyrene, p-n-butylstyrene, p-dodecylstyrene, p-methoxystyrene, p-phenylstyrene, and p-chlorostyrene.

The (meth)acrylic monomer is similar to the (meth)acrylic monomer to be used for preparation of the (meth)acrylic resin.

Preferably the styrene-(meth)acrylic resin contains as an acid group a carboxyl group contained in a unit derived from (meth)acrylic acid. In this case, the acid value of the styrene-(meth)acrylic resin can be adjusted by increasing or decreasing the amount of (meth)acrylic acid used when the styrene-(meth)acrylic resin is prepared.

When the styrene-(meth)acrylic resin is a resin obtained by copolymerizing a styrene monomer, a (meth)acrylic monomer, a monomer having a quaternary ammonium group and a monomer other than the styrene monomer, the (meth)acrylic monomer and the monomer having a quaternary ammonium group, the other monomer is similar to the monomer other than the (meth)acrylic monomer and the monomer having a quaternary ammonium group in the (meth)acrylic resin.

The total of the contents of units derived from the styrene monomer and units derived from the (meth)acrylic monomer that are contained in the styrene-(meth)acrylic resin is preferably 45% by mass or more, more preferably 55% by mass or more, especially preferably 65% by mass or more.

[Monomer Having a Quaternary Ammonium Group]

The resin that forms the shell layer is a resin obtained by copolymerizing at least a monomer having a quaternary ammonium group and a (meth)acrylic monomer. As the monomer having a quaternary ammonium group that is used for preparation of the above-mentioned resin, use of a quaternary ammonium compound synthesized in the alkylation (quaternization) of a tertiary amine having a (meth)acrylate group is preferred because a copolymer with a (meth)acrylic monomer is easily obtained.

Examples of the reagent to be used for quaternization of a tertiary amino group include halogenated alkyls having 1 to 6 (inclusively) carbon atoms, such as methyl chloride, methyl bromide, and ethyl chloride; sulfuric acid esters that are alkyl esters having 1 to 6 (inclusively) carbon atoms, such as dimethyl sulfate, diethyl sulfate, methyl benzenesulfonate, and methyl p-toluenesulfonate; and halogenated aralkyls having 7 carbon atoms or more and 10 carbon atoms or less, such as benzyl chloride. Two or more monomers having a quaternary ammonium group may be combined and used.

The molar ratio of units derived from the monomer having a quaternary ammonium group in the copolymer that is the resin that forms the shell layer is 5 mol % or more and 35 mol % or less, and more preferably 5 mol % or more and 10 mol % or less.

When an image is formed by using a toner composed of toner particles including shell layers formed by using a copolymer having an excessively low molar ratio of units derived from the monomer having a quaternary ammonium group, it is hard to charge toner particles to a desired charge level in a short time, and image failure such as color spot or fogging tends to occur in the formed image. In this case, when toner particles are stirred in a developing unit for a long time, it is hard to charge toner particles to a desired charge value, and it therefore is difficult to suppress fogging in the formed image.

When an image is formed by using a toner composed of toner particles including shell layers formed by using a copolymer having an excessively high molar ratio of units derived from the monomer having a quaternary ammonium group, toner particles are easily charged to a desired charge level in a short time. In this case, however, when toner particles are stirred in a developing unit for a long time, it is hard to charge toner particles to a desired charge value, so that it is difficult to suppress fogging in the formed image. When toner particles are prepared by using a copolymer having an excessively high molar ratio of units derived from the monomer having a quaternary ammonium group, it is hard to properly coat the surfaces of core particles with shell layers. In this case, the release agent tends to exude onto the surfaces of the toner particles, and therefore it is difficult to obtain a toner with excellent storage stability. In addition, it is difficult to suppress degradation of the quality of the formed image as a result of adhesion of toner particles onto the developing sleeve and the photoconductor drum.

The softening point of the resin that forms the shell layer is preferably 95° C. to 140° C. (inclusively), more preferably 100° C. or more and 130° C. or less, and especially preferably 105° C. or more and 125° C. or less. When an image is formed by using a toner composed of toner particles including shell layers composed of a resin having an excessively high softening point, it may be hard to fix the toner properly at low temperatures. A toner composed of toner particles including shell layers composed of a resin having an excessively low softening point may have poor heat-resistant storage stability. The softening point of the resin that forms the shell layer can be measured by a method similar to the above-described method for measurement of the softening point of the binder resin.

The glass transition point ($Tg_2$) of the resin that forms the shell layer is preferably 45° C. or more and 80° C. or less, more preferably 60° C. or more and 70° C. or less, and especially preferably 63° C. or more and 68.5° C. or less. A toner composed of toner particles including shell layers composed of a resin having an excessively low $Tg_2$ may experience agglomeration of toner particles in a high-temperature and high-humidity environment. When an image is formed by using a toner composed of toner particles including shell layers composed of a resin having an excessively high $Tg_2$, it may be hard to properly fix the toner at low temperatures. The glass transition point of the resin that forms the shell layer can be measured by a method similar to the above-described method for measurement of the glass transition point of the binder resin.

The number-average molecular mass (Mn) of the resin that forms the shell layer is preferably 3,000 or more and 1,000,000 or less, and more preferably 5,000 or more and 500,000 or less. The molecular mass distribution (Mw/Mn) expressed as the ratio of the mass-average molecular mass (Mw) to the number-average molecular mass (Mn) is preferably 2 or more and 30 or less, and more preferably 3 or more and 10 or less. The number-average molecular mass (Mn) and the mass-average molecular mass (Mw) of the resin that forms the shell layer can be measured by gel permeation chromatography.

The mass of the shell layer is preferably 5 parts by mass or more and 25 parts by mass or less based on 100 parts by mass of the binder resin contained in core particles.

External Additive

The toner particle may have an external additive attached on the surface as required. In the description and claims of the present application, in some cases particles before being treated with an external additive are described as toner base particles.

The external additive may be exemplified by silica and metal oxides such as alumina, titanium oxide, magnesium oxide, zinc oxide, strontium titanate, and barium titanate. These external additives may be used in a combination of two or more.

These external additives can also be hydrophobized with a hydrophobing agent such as an aminosilane coupling agent or silicone oil and may be used. When a hydrophobized external additive is used, a decrease in the charge value of the toner at high temperatures and high humidity is easily suppressed, and a toner with excellent fluidity is easily obtained.

The particle diameter of the external additive is preferably 0.01 μm or more and 1.0 μm or less.

The amount of the external additive used is preferably 1 part by mass or more and 10 parts by mass or less, and more preferably 2 parts by mass or more and 5 parts by mass or less based on 100 parts by mass of the toner base particles.

Carrier

The toner may be mixed with a desired carrier and used as a two-component developer. In cases of preparing the two-component developer, a magnetic carrier is preferably used.

A carrier, whose carrier core material is coated with a resin, may be exemplified as a preferable carrier. The carrier core material may be exemplified by metal particles of iron, oxidized iron, reduced iron, magnetite, copper, silicon steel, ferrite, nickel, or cobalt; alloy particles of these materials and metals such as manganese, zinc, and aluminum; alloy particles such as iron-nickel alloy or iron-cobalt alloy; ceramic particles of titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; particles of higher permittivity materials such as ammonium dihydrogen phosphate, potassium dihydrogen phosphate, and Rochelle salts; resin carriers containing these magnetic particles dispersed in resins; and the like.

The resin, which coats the carrier core material, may be exemplified by (meth)acrylic polymers, styrene polymers, styrene-(meth)acrylic copolymers, olefin polymers (polyethylene, chlorinated polyethylene, and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (polytetrafluoroethylene, polychlorotrifluoroethylene, and polyvinylidene fluoride), phenol resins, xylene resins, diallyl phthalate resins, polyacetal resins, and amino resins. These resins may be used in a combination of two or more.

Particle diameter of the carrier is preferably 20 μm or more and 120 μm or less, and more preferably 25 μm or more 80 μm or less as a particle diameter measured by an electron microscope.

When the toner is used as a two-component developer, the content of the toner is preferably 3% by mass or more and 20% by mass or less, more preferably 5% by mass or more and 15% by mass or less based on the mass of the two-component developer.

By ensuring that the toner content of a two-component developer falls within the above-described range, an appropriate image density of the formed image can be maintained, and scattering of the toner from an image-forming apparatus can be suppressed to thereby inhibit contamination of the inside of the image-forming apparatus and adhesion of toner particles on a recording medium such as a transfer sheet.

The toner for electrostatic-charge image development according to the first embodiment of the present disclosure as explained above has excellent heat-resistant storage stability. When an image is formed by using the toner for electrostatic-charge image development according to the first embodiment of the present disclosure, occurrence of an image failure, such as color spot or fogging, in the formed image, and degradation of the quality of the formed image by the adhesion of toner particles onto a developing sleeve and a photoconductor drum can be suppressed. Even when the toner is stirred in a developing unit for a long time, toner particles contained in the toner are charged to a desired charge value, so that fogging in the formed image can be suppressed. Therefore, the toner for electrostatic-charge image development according to the first embodiment is suitably used in various image-forming apparatuses.

The method for producing the toner for electrostatic-charge image development according to the first embodiment is not particularly limited, but the preferred production method is exemplified by a method for production of a toner for electrostatic-charge image development according to the second embodiment as explained below. The method for producing electrostatic-charge image development according to the second embodiment is explained in detail below.

Second Embodiment

The second embodiment of the present disclosure relates to a method for producing electrostatic-charge image development that is capable of suitably producing the toner for electrostatic-charge image development according to the first embodiment.

The typical method for producing toner particles including a polyester resin as a binder resin and having a core-shell structure is exemplified by the following. First, core particles including a polyester resin are dispersed in an aqueous medium in the presence of an anionic dispersant or a nonionic dispersant. Then, resin fine particles are attached onto the surfaces of core particles. Thereafter, resin fine particles on the surfaces of core particles are transformed into a film by heat to form shell layers.

However, in the conventional method for producing toner particles having a core-shell structure, when fine particles of a resin with a large amount of quaternary ammonium groups are used, resin fine particles tend to aggregate at the time of adhesion of resin fine particles on core particles. Therefore, it may be difficult to attach a predetermined amount of resin fine particles on the core particles, or to uniformly attach resin fine particles on the surfaces of core particles.

However, according to the method for producing a toner for electrostatic-charge image development according to the second embodiment as explained below, toner particles having a core-shell structure with core particles coated with shell layers having a predetermined and uniform thickness can be easily produced even when the material of the shell layer is a resin with a large amount of quaternary ammonium groups.

The method for producing a toner for electrostatic-charge image development according to the second embodiment of the present disclosure is a method for producing toner particles for electrostatic-charge image development in which the surfaces of core particles including a binder resin composed of a polyester resin are coated with shell layers, the method including steps (I) to (IV). Step (I) is a core particle dispersion-preparing step of obtaining an aqueous dispersion (1) containing core particles including a binder resin composed of a polyester resin, where aqueous dispersion (1) contains an anionic or nonionic dispersant. Step (II) is a mixing step of mixing aqueous dispersion (1) adjusted to a pH of 5 or less and an aqueous dispersion (2) containing resin fine particles to obtain an aqueous dispersion (3) containing the core particles and the resin fine particles. Step (III) is a coating step of adjusting the pH of aqueous dispersion (3) to 6 or more and 10 or less, followed by heating aqueous dispersion (3) to coat the surfaces of the core particles with the resin fine particles, thereby obtaining an aqueous dispersion (4) containing core particles coated with resin fine particles. Step (IV) is a film-forming step of adjusting the pH of aqueous dispersion (4) to 5 or less, followed by heating of aqueous dispersion (4) to transform the resin fine particles, with which the surfaces of the core particles are coated, into a film, thereby obtaining toner particles (toner base particles).

The shell layer is composed of a resin composed of a copolymer of monomers including a monomer having a quaternary ammonium group and a (meth)acrylic monomer. The molar ratio of units derived from the monomer having a quaternary ammonium group in the copolymer is 5 mol % or more and 35 mol % or less.

The method for producing a toner for electrostatic-charge image development in the present disclosure may include the following steps (V) to (VII) as required in addition to above-described steps (I) to (IV).

(V): Cleaning step of cleaning toner particles.

(VI): Drying step of drying toner particles.

(VII): External addition step of attaching an external additive on the surfaces of toner base particles.

Steps (I) to (VII) are explained in order below.

((I) Core Particle Dispersion-Preparing Step)

In the core particle dispersion-preparing step, an aqueous dispersion (1) containing core particles including a binder resin composed of a polyester resin, where aqueous dispersion (1) contains an anionic or nonionic dispersant, is obtained. The polyester resin contained as a binder resin in core particles is similar to the polyester resin contained as a binder resin in toner particles contained in the toner of the first embodiment. The preferred method as a method for producing aqueous dispersion (1) is exemplified by a method of producing an aqueous dispersion containing core particles by an aggregation method, and a method of dispersing core particles obtained by a melting/kneading method in an aqueous medium.

Method of Producing Aqueous Dispersion (1) Containing Core Particles by an Aggregation Method The method of obtaining aqueous dispersion (1) containing core particles by using an aggregation method is preferred because core particles, which are uniform in shape and particle diameter, are easily obtained. Preferably the method of producing aqueous dispersion (1) containing core particles by an aggregation method includes the following steps (i) and (ii). Step (i) is the step of obtaining an aqueous dispersion (A) containing fine particles including a binder resin, followed by aggregation of the fine particles including a binder resin in the presence of an aggregating agent to obtain an aqueous dispersion (B) containing aggregated particles including a binder resin. Step (ii) is the step of heating aqueous dispersion (B) to coalesce the aggregated particles, thereby obtaining aqueous dispersion (1) containing core particles having a desired particle diameter. The step of obtaining aqueous dispersion (A), the step of obtaining aqueous dispersion (B), and the step of heating aqueous dispersion (B) are explained below.

Step of Obtaining Aqueous Dispersion (A)

The method for preparing aqueous dispersion (A) containing fine particles including a binder resin is not particularly limited. The fine particles including a binder resin may be fine particles of a resin composition containing a binder resin and optional components such as a colorant, a release agent, and a charge-control agent.

Usually, fine particles including a binder resin are prepared as an aqueous dispersion containing fine particles by transforming a binder resin or a composition containing a binder resin into fine particles with a desired size in an aqueous medium. The aqueous dispersion containing fine particles may contain fine particles other than fine particles including a binder resin. Examples of fine particles other than fine particles containing a binder resin include fine particles of a colorant, fine particles of a release agent, and fine particles including a colorant and a release agent. A method for preparing fine particles including a binder resin, a method for preparing fine particles of a colorant, and a method for preparing fine particles of a release agent are explained in order below. Fine particles including components different from the fine particles explained herein can be prepared by appropriately selecting a method for producing these fine particles.

(Preparation of Fine Particles Including Binder Resin)

First, a binder resin, or a resin composition containing a binder resin and optional components that may be included in core particles, is coarsely pulverized by using a pulverizing device such as a turbo mill. The coarsely pulverized product is dispersed in an aqueous medium such as ion-exchanged water and, in this state, is heated to a temperature at least 10° C. above the softening point of the binder resin as measured by a flow tester (a temperature of at most about 200° C.). A strong shear force is applied to the heated aqueous-medium dispersion of the binder resin by using a high-speed shearing emulsifier such as CLEAR MIX (manufactured by M. Technique Co., Ltd.), thereby obtaining aqueous dispersion (A) containing fine particles including a binder resin.

The volume-average particle diameter ($D_{50}$) of fine particles including a binder resin is preferably 1 μm or less, and more preferably 0.05 μm or more and 0.5 μm or less. When a toner is prepared by using fine particles including a binder resin and having a particle diameter in the above-described range, toner particles having a sharp particle-diameter distribution and a uniform shape are easily obtained, and therefore variations in toner performance and productivity are small. The volume-average particle diameter ($D_{50}$) of fine particles including a binder resin can be measured by using a laser diffraction-type particle size distribution-measuring device (SALD 2200 (manufactured by Shimadzu Corporation)).

In core particle dispersion-preparing step (I), an aqueous dispersion (1) including core particles, where aqueous dispersion (1) contains an anionic or nonionic dispersant, is obtained. Therefore, it is preferred to disperse fine particles in an aqueous medium by adding an anionic or nonionic dispersant to the aqueous dispersion containing fine particles including a binder resin, the aqueous dispersion containing release fine particles, and the aqueous dispersion containing colorant fine particles. By adding an anionic or nonionic dispersant to the aqueous medium, the formation of fine particles is made to proceed properly, so that an aqueous dispersion with excellent dispersion stability of fine particles is easily obtained.

Examples of the anionic dispersant include sulfuric acid ester salt-type dispersants, sulfonic acid salt-type dispersants, phosphoric acid ester salt-type dispersants, and soaps. Examples of the nonionic dispersant include polyethylene glycol-type dispersants, alkylphenol ethylene oxide adduct-type dispersants, and polyhydric alcohol-type dispersants that are derivatives of polyhydric alcohols, such as glycerin, sorbitol, and sorbitan. These dispersants may be used alone or in combinations of two or more thereof.

The amount of the dispersant used is preferably 1% by mass or more and 5% by mass or less based on the mass of the binder resin or the composition of the binder resin.

The polyester resin that is a binder resin has a carboxyl group as an acid group. When the polyester resin is transformed into fine particles directly in an aqueous medium, the specific surface area thereof increases. Accordingly, the pH of the aqueous medium may decrease to about 3 to 4 under the influence of acid groups exposed at the surface of the polyester resin. In this case, the polyester resin may be hydrolyzed, or fine particles including the binder resin (polyester resin) obtained, may be hard to make particulate to a desired particle size.

To suppress the above-mentioned problems, a basic substance may be added to the aqueous medium when fine particles including a binder resin are being prepared. Examples of the basic substance include alkali-metal hydroxides such as sodium hydroxide, potassium hydroxide, and lithium hydroxide; alkali-metal carbonates such as sodium carbonate and potassium carbonate; alkali-metal hydrogen carbonates such as sodium hydrogen carbonate and potassium hydrogen carbonate; and nitrogen-containing organic bases such as N,N-dimethyl ethanolamine, N,N-diethyl ethanolamine, triethanolamine, tripropanolamine, tributanolamine, triethylamine, n-propylamine, n-butylamine, isopropylamine, monomethanolamine, morpholine, methoxy propylamine, pyridine, and vinylpyridine.

Preparation of Fine Particles of Colorant

A colorant is dispersed together with a dispersant for the colorant as required in an aqueous medium containing an anionic or nonionic dispersant by using a disperser, thereby obtaining fine particles of a colorant. The amount of the anionic or nonionic dispersant used is not particularly limited, but is preferably equal to or greater than the critical micelle concentration (CMC).

Pressure-type dispersers such as an ultrasonic disperser, a mechanical homogenizer, a Manton Gaulin homogenizer, and a pressure-type homogenizer; and medium-type dispersers such as a sand grinder, a Gettman mill, and a diamond fine mill can be used as the disperser that is used for dispersion treatment.

The volume-average particle diameter ($D_{50}$) of fine particles of a colorant is preferably 0.05 μm or more and 0.2 μm or less. The volume-average particle diameter ($D_{50}$) of fine particles of a colorant can be measured by a method similar to that used for fine particles including a binder resin.

Preparation of Fine Particles of Release Agent

The release agent is coarsely pulverized to about 100 μm or less beforehand to obtain a release agent powder. The release agent powder is added to an aqueous medium containing an anionic or nonionic dispersant, thereby preparing a slurry. Then, the obtained slurry is heated to a temperature equal to or above the melting point of the release agent. A strong shear force is applied to the heated slurry by using a homogenizer or a pressure-discharge type disperser to prepare a dispersion of fine particles including a release agent.

Normally, the melting point of the release agent is often 100° C. or lower. In this case, the release agent may be heated to a temperature equal to or above its melting point at atmospheric pressure, followed by transforming the release agent into fine particles by using a conventional homogenizer. When the melting point of the release agent is above 100° C., the release agent can be transformed into fine particles by forming fine particles in a pressure-proof device.

The volume-average particle diameter ($D_{50}$) of the fine particles of the release agent is preferably 1 μm or less, more preferably 0.1 μm or more and 0.3 μm or less. Core particles with a release agent uniformly dispersed in a binder resin are easily obtained by using fine particles of the release agent with a particle diameter in the above-described range to prepare the core particles. The volume-average particle diameter ($D_{50}$) of fine particles of a release agent can be measured by a method similar to that used for fine particles including a binder resin.

Step of Obtaining Aqueous Dispersion (B)

Aqueous dispersion (B) containing aggregated particles including a binder resin can be obtained by properly combining an aqueous dispersion containing release agent fine particles and an aqueous dispersion containing colorant fine particles, as required, with aqueous dispersion (A) containing fine particles of a binder resin prepared by the above-described method, so that predetermined components are included in core particles. Examples of the method for aggregating fine particles include a method in which the pH of aqueous dispersion (A) containing fine particles of a binder resin is adjusted, an aggregating agent is added to aqueous dispersion (A), and the temperature of aqueous dispersion (A) is adjusted to a predetermined value to aggregate fine particles.

The pH of aqueous dispersion (A) at the time of addition of an aggregating agent is preferably 8 or less. The aggregating agent may be added all at once or sequentially.

Examples of aggregating agents that may be added to aqueous dispersion (A) include inorganic metal salts, inorganic ammonium salts, and divalent or higher-valent metal complexes. Examples of the inorganic metal salt include metal salts such as sodium sulfate, sodium chloride, calcium chloride, calcium nitrate, barium chloride, magnesium chloride, zinc chloride, aluminum chloride, and aluminum sulfate; and inorganic metal salt polymers such as polyaluminum chloride and polyaluminum hydroxide. Examples of the inorganic ammonium salt include ammonium sulfate, ammonium chloride, and ammonium nitrate. Cationic surfactants of the quaternary ammonium salt type and nitrogen-containing compound such as polyethylenimines may also be used as the aggregating agent.

Divalent metal salts and monovalent metal salts are suitably used as the aggregating agent. A single aggregating agent may be used, or two or more aggregating agents may be combined and used. When two or more aggregating agents are combined and used, it is preferred to use a divalent metal salt and a monovalent metal salt in combination. The divalent metal salt and the monovalent metal salt provide different aggregation rates to fine particles, and therefore by using these metal salts in combination, the particle-size distribution of the aggregated particles is easily made sharp while the particle diameter of the aggregated particles obtained is controlled to fall within a desired range.

The additive amount of the aggregating agent is preferably 0.1% by mass or more and 25% by mass or less based on the solid content of aqueous dispersion (A). Preferably the additive amount of the aggregating agent is appropriately adjusted according to the type and amount of anionic or nonionic dispersant contained in the fine-particle dispersion.

Preferably aqueous dispersion (A) is heated to a temperature equal to or above the glass transition point ($Tg_1$) of the binder resin and below $Tg_1$+10° C. when the fine particles are aggregated. By heating aqueous dispersion (A) to a temperature in the above-described range, aggregation of the fine particles contained in aqueous dispersion (A) can be made to proceed properly.

After aggregation proceeds until the aggregated particles have the desired particle diameter, an aggregation-terminating agent may be added. Examples of the aggregation-terminating agent include sodium chloride, potassium chloride, and magnesium chloride. In this way, aqueous dispersion (B) containing aggregated particles can be obtained.

Step of Heating Aqueous Dispersion (B)

Aqueous dispersion (B) containing aggregated particles as obtained in the manner described above is heated to coalesce components included in the aggregated particles, thereby obtaining aqueous dispersion (1) containing core particles having a desired particle diameter. Preferably aqueous dispersion (B) is heated to a temperature no lower than $Tg_1$+10° C. and no higher than the melting point of the binder resin used in coalescing the aggregated particles. By heating aqueous dispersion (B) to a temperature in the above-described range, coalescing of the components included in the aggregated particles can be made to proceed properly.

Method for Production of Aqueous Dispersion (1) Containing Core Particles by Melting/Kneading Method Aqueous dispersion (1) containing core particles can be obtained by dispersing core particles in an aqueous medium containing an anionic or nonionic dispersant after core particles are obtained by a melting/kneading method. The melting/kneading method is a method in which a binder resin is mixed with optional components such as a colorant, a release agent, a charge-control agent, and a magnetic powder, the mixture is then melted and kneaded, and the melted/kneaded product obtained is pulverized and classified to obtain core particles having a desired particle diameter.

Core particles obtained by the melting/kneading method described above are mixed with an aqueous medium containing an anionic or nonionic dispersant, followed by sufficient stirring of the mixed liquid to adequately disperse the core particles in the aqueous medium, thereby preparing aqueous dispersion (1) containing core particles.

(Mixing Step (II))

In mixing step (II), first the pH of aqueous dispersion (1) containing core particles obtained in the manner described above is adjusted to 5 or less. By ensuring that the pH of aqueous dispersion (1) containing core particles is 5 or less, resin fine particles contained in aqueous dispersion (2) are easily properly dispersed in an aqueous medium when aqueous dispersion (1) is mixed with aqueous dispersion (2) containing resin fine particles as described later.

When the pH of aqueous dispersion (1) in mixing step (II) exceeds 5, resin fine particles tend to aggregate in the aqueous medium. Consequently, in step (III), described later, it may be hard to coat the surfaces of core particles with resin fine particles in a desired state. In this case, in the obtained toner, the release agent tends to exude to the surfaces of toner particles, and therefore it is difficult to obtain toner with excellent storage stability in a high-temperature and high-humidity environment. When an image is formed by using a toner in which agglomeration of toner particles occurs, it is hard to charge toner particles to a predetermined charge level in a short time, and color spot or fogging tends to occur in the formed image.

After the pH of aqueous dispersion (1) is adjusted to 5 or less, aqueous dispersion (1) is mixed with aqueous dispersion (2) containing resin fine particles to obtain aqueous dispersion (3) containing core particles and resin fine particles. A method for preparing aqueous dispersion (2) is explained below.

The resin fine particles contained in aqueous dispersion (2) are composed of a resin that is a copolymer of monomers including a monomer having a quaternary ammonium group and a (meth)acrylic monomer, wherein the molar ratio of units derived from the monomer having a quaternary ammonium group in the copolymer is 5 mol % or more and 35 mol % or less.

Resin fine particles contained in aqueous dispersion (2) are prepared by polymerizing a monomer of predetermined composition in an aqueous medium by a known method. When resin fine particles are prepared in an aqueous medium, polymerization conditions such as temperature and polymerization time, the type and the amount used of polymerization initiator, are appropriately adjusted to adjust the particle diameter of the resin fine particles obtained and the molecular mass and Tg of the resin.

The volume-average particle diameter of resin fine particles is preferably 0.03 μm or more and 0.50 μm or less, more preferably 0.05 μm or more and 0.30 μm or less. The volume-average particle diameter of the resin fine particles with which the core particles are coated can be measured with an electrophoresis light-scattering photometer (LA-950 V2 (manufactured by HORIBA, Ltd.)).

Preferably, mixing of aqueous dispersion (1) with aqueous dispersion (2) is performed at a temperature that is less than 10° C. higher than the glass transition point (Tgd of resin fine particles. By ensuring that the temperature at which aqueous dispersion (1) is mixed with aqueous dispersion (2) has a value within the above-described range, core particles and resin fine particles can be properly dispersed in the aqueous medium.

The mixing ratio of aqueous dispersion (1) and aqueous dispersion (2) is preferably such that the mass of resin fine particles contained in the aqueous dispersion (2) is 5 parts by mass or more and 25 parts by mass or less based on 100 parts by mass of the binder resin included in core particles contained in aqueous dispersion (1).

(Coating Step (III))

In coating step (III), the pH of aqueous dispersion (3) is adjusted to 6 or more and 10 or less, followed by heating of aqueous dispersion (3) to coat the surfaces of the core particles with the resin fine particles, thereby obtaining aqueous dispersion (4) containing core particles coated with resin fine particles. By ensuring that the pH of aqueous dispersion (3) has a value within the above-described range, coating of the surfaces of core particles with resin fine particles can be made to proceed properly.

The temperature of aqueous dispersion (3) at the time of heating of aqueous dispersion (3) is preferably a temperature equal to or above $Tg_2$−10° C. and below $Tg_2$. By heating aqueous dispersion (3) to a temperature within the above-described range, coating of core particles with resin fine particles can be made to proceed properly.

(Film-Forming Step (IV))

In film-forming step (IV), the pH of aqueous dispersion (4) containing core particles coated with resin fine particles that is prepared in coating step (III) is adjusted to 5 or less, followed by heating of aqueous dispersion (4) to transform the resin fine particles with which the surfaces of the core particles are coated into a film. By ensuring that the pH of aqueous dispersion (4) has a value within the above-described range, the transformation of the resin particles with which the core particles are coated, into a film, can be made to proceed properly.

The temperature at which aqueous dispersion (4) is heated is preferably no lower than $Tg_2$ and no higher than $Tg_2$+5° C. By heating aqueous dispersion (4) to a temperature within the above-described range, the transformation of the resin particles with which the core particles are coated, into a film, can be made to proceed properly.

(Step (V))

The toner particles obtained in step (IV) are cleaned with water as required. Examples of the cleaning method include a method in which toner particles are collected as a wet cake through solid-liquid separation from a dispersion of toner particles, and the obtained wet cake is cleaned with water, and a method in which toner particles in the dispersion of toner particles are settled down, the supernatant is replaced with water, and, after replacement, the toner particles are redispersed in water.

(Step (VI))

The toner particles obtained from Step (IV) are dried as required. The method for drying the toner particles is not particularly limited. Preferable drying methods may include a method using a dryer such as a spray dryer, fluidized-bed dryer, vacuum freeze dryer, or decompression dryer. Of these methods, the method using a spray dryer is more preferable since agglomeration of toner particles during drying may be easily suppressed. When using the spray dryer, an external additive can be attached to surfaces of toner particles by spraying a dispersion of the external additive such as silica together with the dispersion of toner particles.

(Step (VII))

Toner particles contained in the toner for electrostatic-charge image development produced by the method of the present disclosure may have an external additive attached on their surfaces as required. When toner particles are collected as toner base particles by the method described above, an external additive is attached on the surfaces of the toner base particles in external addition step (VII). Examples of the preferred method include a method in which a mixer such as a Henschel mixer or a Nauta mixer is used to mix toner base particles with an external additive while conditions are adjusted so that the external additive is not embedded in the surfaces of the toner base particles.

According to the method for producing a toner for electrostatic-charge image development in the present disclosure as explained above, the toner according to the first embodiment can be prepared easily.

EXAMPLES

The present disclosure is explained more specifically below by way of examples. The present disclosure is not limited to the examples.

Preparation Example 1

Preparation of Polyester-Resin Fine-Particle Dispersion A

In accordance with the following method, an aqueous dispersion containing polyester-resin fine particles was prepared by using the amorphous polyester resin A described below.

(Amorphous Polyester Resin A)

melting point (Tm): 74.7° C.

glass transition point ($Tg_1$): 37.5° C.

acid value: 20.5 mg KOH/g

The amorphous polyester resin A was coarsely pulverized to an average particle diameter of about 10 μm in a T250 Turbo Mill (manufactured by Turbo Kogyo Co., Ltd.). 100 g of the coarsely pulverized product obtained, 2 g of an anionic dispersant (EMAL 0 (manufactured by Kao Corporation)), 2 g of SDS (sodium dodecyl sulfate)), and 50 g of a 0.1N aqueous solution of sodium hydroxide were mixed. To the obtained mixture was added ion-exchanged water to prepare a slurry of 500 g in total. The obtained slurry was poured into a pressure-proof round-bottom stainless container. Then, the slurry was shear-dispersed for 30 minutes at a rotor speed of 20,000 rpm by using a CLEAR MIX high-speed shearing emulsifier (CLM-2.2S, (manufactured by M. Technique Co., Ltd.)) under conditions of 140° C. and a pressure of 0.5 MPa (G). Thereafter, the slurry was cooled at a rate of 5° C./min while stirring was continued at a rotor speed of 15,000 rpm until the internal temperature of the stainless container reached 50° C. To the cooled slurry was added ion-exchanged water so that the solid concentration was 20% by mass, thereby obtaining a polyester-resin fine-particle dispersion A. The volume-average particle diameter ($D_{50}$) of polyester-resin fine particles in the dispersion was 0.15 μm. The volume-average particle diameter of resin fine particles in the dispersion was measured with a particle diameter distribution-measuring device (LA-950V2 (manufactured by HORIBA, Ltd.).

[Preparation of Polyester-Resin Fine-Particle Dispersion B]

In accordance with the following method, an aqueous dispersion containing polyester-resin fine particles was prepared by using the amorphous polyester resin A described above and the amorphous polyester resin B described below.

(Amorphous Polyester Resin B)

melting point (Tm): 85.1° C.

glass transition point ($Tg_1$): 47.3° C.

acid value: 15.6 mg KOH/g

The amorphous polyester resin B was coarsely pulverized by using a T250 Turbo Mill (manufactured by Turbo Kogyo Co., Ltd.) to obtain a coarsely pulverized product of the amorphous polyester resin B having an average particle diameter of about 10 μm. A polyester-resin fine-particle dispersion B was obtained in the same manner as that for the polyester-resin fine-particle dispersion A, except that 100 g of the coarsely pulverized product of the amorphous polyester resin A was changed to a mixture of 50 g of the coarsely pulverized product of the amorphous polyester resin A and 50 g of the coarsely pulverized product of the amorphous polyester resin B. The volume-average particle diameter ($D_{50}$) of resin fine particles in the dispersion was 0.17 μm.

Preparation Example 2

Preparation of Acrylic Resin Fine Particle Dispersions A to G

A four-necked flask equipped with a stirrer (max blend wing (inner diameter 60 mm, height 280 mm)), a condenser, a thermometer, and a nitrogen inlet pipe and having a volume of 2 liters was used as the reaction vessel. Diethylaminoethyl methacrylate and methyl p-toluenesulfonate in the amounts shown in Table 1 were put in the reaction vessel containing 180 g of isobutanol as a solvent. The reaction vessel was placed on a mantle heater, and nitrogen gas was introduced into the reaction vessel via a glass nitrogen inlet pipe to produce an inert atmosphere in the reaction vessel. Then, the internal temperature of the reaction vessel was raised to 80° C. while the mixture was stirred at a speed of 200 rpm. Stirring was continued at the same temperature for 1 hour to carry out a quaternization reaction.

After the quaternization reaction, to the contents in the reaction vessel were added styrene or methyl methacrylate in the amount described in Table 1, 72 g of butyl acrylate, and 12 g of t-butyl peroxy-2-ethylhexanoate (manufactured by ARKEMA YOSHITOMI, LTD.) as a peroxide-based initiator. Then, the internal temperature was raised to 95° C. (the polymerization temperature), followed by stirring of the contents in the reaction vessel at a speed of 200 rpm for 3 hours. Thereafter, to the contents in the reaction vessel was added 6 g of t-butyl peroxy-2-ethylhexanoate, and the mixture was stirred at a speed of 200 rpm for 3 hours to terminate the polymerization reaction, thereby obtaining an acrylic resin fine particle dispersion. The volume-average particle diameter ($D_{50}$), the copolymerization ratio of quaternary ammonium salt of the diethylaminoethyl methacrylate monomer, the melting point (Tm), the glass transition point ($Tg_2$), the particle diameter, of resin fine particles in the obtained dispersion of acrylic resin fine particles, and the solid concentration in the obtained dispersion of acrylic resin fine particles are shown in Table 1.

TABLE 1

| | Acrylic resin fine particle dispersions | | | | | | |
|---|---|---|---|---|---|---|---|
| | A | B | C | D | E | F | G |
| Quaternization reaction | | | | | | | |
| Diethylaminoethyl methacrylate (g) | 16 | 23 | 16 | 8 | 45 | 5 | 60 |
| Methyl p-toluenesulfonate (g) | 16 | 23 | 16 | 8 | 45 | 5 | 60 |
| Polymerization reaction | | | | | | | |
| Styrene (g) | 214 | 200 | — | 230 | 155 | 240 | 125 |
| Methyl methacrylate (g) | — | — | 200 | — | — | — | — |
| Butyl acrylate (g) | 72 | 72 | 72 | 72 | 72 | 72 | 72 |
| Volume-average particle diameter (μm) | 0.19 | 0.14 | 0.11 | 0.18 | 0.07 | 0.24 | 0.06 |
| Copolymerization ratio of quaternary ammonium salt (mol %) | 10.1 | 15.3 | 9.8 | 4.9 | 29.5 | 3.2 | 39.6 |
| Melting point(Tm, ° C.) | 115.2 | 112.4 | 105.4 | 122.6 | 112.2 | 127.1 | 109.9 |
| Glass transition point ($Tg_2$, ° C.) | 68.1 | 66.1 | 64.2 | 69.3 | 64.4 | 69.0 | 61.7 |
| Particle diameter (nm) | 135.0 | 86.0 | 137.0 | 141.0 | 59.0 | 132.0 | 56.0 |
| Solid concentration (% by mass) | 20.1 | 19.9 | 20.3 | 20.0 | 19.6 | 19.2 | 21.1 |

Preparation Example 3

Preparation of Colorant Fine-Particle Dispersion 21 g of an anionic dispersant (EMAL 0 (manufactured by Kao Corporation), SDS (sodium dodecyl sulfate)) was dissolved in 570 g of ion-exchanged water. To the obtained aqueous solution was gradually added 100 g of a cyan colorant (copper phthalocyanine, CTBX 121 (manufactured by DIC Corporation)). Then, the aqueous dispersion containing the cyan colorant was stirred at a speed of 2,000 rpm for 5 minutes by using a homogenizer (Ultra-Turrax T50, (manufactured by IKA Co., Ltd.)) and thereby emulsified. Further, an emulsification treatment was performed five times under treatment conditions of 100° C. and 500 kg/cm$^2$ by using a Gaulin homogenizer (15M-8TA (manufactured by APV Co., Ltd.)). As a result, a colorant fine-particle dispersion having a solid concentration of 15% by mass was obtained. The volume-average particle diameter ($D_{50}$) of colorant fine particles in the dispersion was 0.21 μm.

Preparation Example 4

Preparation of Release Agent Fine-Particle Dispersion 200 g of a release agent (WEP-5, ester compound of pentaerythritol and saturated fatty acid having 14 to 20 (inclusively) carbon atoms, melting point of 73° C. (manufactured by the NOF Corporation), 1 g of an anionic dispersant (EMAL 0 (manufactured by Kao Corporation), SDS (sodium dodecyl sulfate)), and 800 g of ion-exchanged water were mixed, and the mixture was heated at 100° C. to melt the release agent. Then, the mixed liquid of water and the release agent was stirred at a stirring speed of 2,000 rpm for 5 minutes by using a homogenizer (Ultra-Turrax T50, (manufactured by IKA Co., Ltd.)) and thereby emulsified. Further, emulsification treatment was performed five times under treatment conditions of 100° C. and 500 kg/cm$^2$ by using a Gaulin homogenizer (15M-8TA (manufactured by APV Co., Ltd.)). As a result, a release agent fine-particle dispersion having a solid concentration of 20% by mass was obtained. The volume-average particle diameter ($D_{50}$) of release agent fine particles in the dispersion was 0.15 μm.

Preparation Example 5

Preparation of Silica 100 g of dimethyl polysiloxane (manufactured by Shin-Etsu Chemical Co., Ltd.), and 100 g of 3-aminopropyltrimethoxysilane (manufactured by Shin-Etsu Chemical Co., Ltd.) were dissolved in 200 g of toluene, followed by 10-fold dilution of the solution. Then, while 200 g of Fumed Silica Aerosil #90 (manufactured by Nippon Aerosil Co., Ltd.) was stirred, the diluted solution of dimethyl polysiloxane and 3-aminopropyltrimethoxysilane was gradually added dropwise, followed by mixing of the mixture by performing ultrasonic wave irradiation/stirring for 30 minutes. The mixture obtained was heated in a thermostatic bath at 150° C., and toluene was then distilled away by suing a rotary evaporator to obtain a solid. The obtained solid was dried with a vacuum dryer at a set temperature of 50° C. until the weight no longer decreased. Further, after drying the solid was treated under a nitrogen flow at 200° C. for 3 hours in an electric furnace to obtain a coarse powder of silica. The coarse silica powder was crushed by suing a jet mill (IDS type Jet Mill (manufactured by Nippon Pneumatic Mfg. Co., Ltd.)), and collected by suing a bag filter to obtain silica.

Examples 1 to 16 and Comparative Examples 1 to 6

(I) Core-Particle Dispersion Preparing Step (i) Aggregating Step 480 g of a dispersion of polyester-resin fine particles including polyester-resin fine particles of the types described in tables 2 to 4, 90 g of a release agent fine-particle dispersion, 40 g of a colorant fine-particle dispersion, and an aqueous solution (concentration 25% by mass) of an anionic dispersant (EMAL 0 (manufactured by Kao Corporation), SDS (sodium dodecyl sulfate)) in the amount shown in tables 2 to 4, and 542 g of distilled water were put in a stainless round-bottom flask having a volume of 2 L. The contents of the flask were mixed at 25° C. Then, a 1N aqueous solution of sodium hydroxide was added to the flask while the contents of the flask were stirred at a speed of 100 rpm by impellers, and the pH of the mixed liquid was thereby adjusted to the values shown in tables 2 to 4. The pH-adjusted contents of the flask were stirred at 25° C. at a speed of 200 rpm for 10 minutes, and an aggregating agent (a mixed liquid of magnesium chloride and water, magnesium chloride content 50% by mass) in the amounts shown in tables 2 to 4 was then added to the flask over 5 minutes. After the aggregating agent was added, the internal temperature of the flask was raised at a rate of 0.2° C./min while the contents of the flask were stirred at a speed of 200 rpm. The volume-average particle diameter of aggregated particles contained in the contents of the flask that were being heated was measured with a granulometer (Multisizer 3 (manufactured by Beckman Coulter, Inc.)), and the temperature raising was stopped at the time when the volume-average particle diameter of the aggregated particles reached 4.5 μm. The temperature at which the temperature raising was stopped is shown in tables 2 to 4.

(ii) Coalescing Step

Subsequently to aggregating step (i), the internal temperature of the flask was raised to the temperature shown in tables 2 to 4 at a rate of 0.2° C./min, while the dispersion of aggregated particles in the flask was stirred by impellers at a speed of 200 rpm. After the temperature raising, the contents of the flask were stirred at the same temperature for 60 minutes to coalesce the aggregated particles, thereby obtaining an aqueous dispersion containing core particles. For examples 7 and 10, no temperature raising was performed in coalescing step (ii), and the aggregated particles were kept at the temperature at which the temperature raising had been stopped at the end of aggregating step (i), thereby obtaining an aqueous dispersion having core particles. The average roundness of core particles in the aqueous dispersion is shown in tables 2 to 4. The average roundness was measured with an FPIA 3000 (manufactured by Sysmex Corporation).

(Mixing Step (II))

Subsequently to coalescing step (ii), a 2N aqueous hydrochloric acid solution was added to the aqueous dispersion while the aqueous dispersion containing core particles in the flask was stirred by impellers at a speed of 100 rpm, thereby adjusting the pH of the aqueous dispersion to the values shown in tables 5 to 7. Then, 90 g of an acrylic-resin fine-particle dispersion containing acrylic-resin fine particles of the types described in tables 5 to 7 was put in the flask. Thereafter, the contents of the flask were stirred for 15 minutes to obtain an aqueous dispersion containing core particles and acrylic resin fine particles.

(Coating Step (III))

A 1N aqueous sodium hydroxide solution was added to the aqueous dispersion containing core particles and acrylic-resin fine particles obtained in mixing step (II), thereby adjusting the pH of the aqueous dispersion to the values shown in tables 5 to 7. Then the internal temperature of the flask was raised to 60° C. at a rate of 0.2° C./min. Thereafter, the contents of the flask were stirred at the same temperature for 60 minutes to coat the core particles with acrylic-resin fine particles.

(Film-Forming Step (IV))

A 2N aqueous hydrochloric acid solution was added to the aqueous dispersion containing core particles coated with acrylic-resin fine particles that was obtained in coating step (III), thereby adjusting the pH of the aqueous dispersion to the values shown in tables 5 to 7. Then the internal temperature of the flask was raised at a rate of 0.2° C./min to the temperature shown in tables 5 to 7. Thereafter, the contents of the flask were stirred at the same temperature for 120 minutes to transform the resin fine-particle layers, with which the core particles were coated, into a film, thereby forming shell layers. Thereafter, the aqueous dispersion containing toner base particles including shell layers was cooled to 25° C. at a rate of 10° C./min to obtain an aqueous dispersion containing toner base particles.

(Cleaning Step(V))

The aqueous dispersion containing toner base particles was suction-filtered to thereby collect a wet cake of toner base particles by filtering. Then, the wet cake was dispersed in ion-exchanged water again and the toner base particles were cleaned. The same operation was repeated five times to clean toner base particles, followed by collection of a wet cake of toner base particles by filtering.

((VI) Drying Step)

The wet cake of toner base particles was dispersed in an aqueous ethanol solution with a concentration of 50% by mass to prepare a slurry. The obtained slurry was dried under drying conditions with a hot-air temperature of 40° C. and a blower air-flow rate of 2 $m^3$/min for 72 hours in a continuous surface-modifying device (Coatmizer, (manufactured by Freund Sangyo Co., Ltd.)), thereby obtaining toner base particles.

(External Addition Step (VII))

100 g of the toner base particles obtained and the silica obtained through Preparation Example 5 were mixed for 5 minutes in a Henschel mixer (manufactured by Mitsui Miike Machinery Co., Ltd., capacity 5 L). Thereafter, the obtained mixture was screened by using a 300-mesh screen (#300 mesh, opening 48 μm) to obtain the toners of examples 1 to 16 and comparative examples 1 to 6.

TABLE 2

| | Examples | | | | | | | |
|---|---|---|---|---|---|---|---|---|
| | 1 | 2 | 3 | 4 | 5 | 6 | 7 | 8 |
| Types of polyester-resin fine particles | A | A | A | B | A | A | A | A |
| Amount of aqueous solution of SDS | 48 | 48 | 48 | 48 | 48 | 48 | 144 | 24 |
| Aggregation conditions | | | | | | | | |
| pH | 7.46 | 7.88 | 7.78 | 7.65 | 7.53 | 7.68 | 7.35 | 7.42 |
| Amount of aggregating agent ($MgCl_2$) (g) | 39 | 39 | 39 | 39 | 39 | 39 | 39 | 117 |
| Temperature (° C.) | 44 | 44 | 45 | 53 | 45 | 44 | 55 | 38 |
| Average roundness of aggregated particles | 0.899 | 0.902 | 0.901 | 0.911 | 0.904 | 0.896 | 0.926 | 0.834 |
| Coalescence conditions | | | | | | | | |
| Temperature (° C.) | 55 | 55 | 55 | 58 | 55 | 55 | — | 55 |
| Average roundness of core particles | 0.932 | 0.933 | 0.934 | 0.928 | 0.936 | 0.93 | — | 0.936 |

TABLE 3

| | Examples | | | | | | | |
|---|---|---|---|---|---|---|---|---|
| | 9 | 10 | 11 | 12 | 13 | 14 | 15 | 16 |
| Types of polyester-resin fine particles | A | A | A | A | A | A | A | A |
| Amount of aqueous solution of SDS | 48 | 144 | 48 | 48 | 48 | 48 | 48 | 48 |
| Aggregation conditions | | | | | | | | |
| pH | 7.41 | 7.75 | 7.58 | 7.88 | 7.69 | 7.59 | 7.64 | 7.52 |
| Amount of aggregating agent ($MgCl_2$) (g) | 39 | 20 | 39 | 39 | 39 | 39 | 39 | 39 |
| Temperature (° C.) | 44 | 59 | 44 | 44 | 45 | 44 | 44 | 45 |
| Average roundness of aggregated particles | 0.902 | 0.945 | 0.889 | 0.900 | 0.891 | 0.894 | 0.904 | 0.908 |
| Coalescence conditions | | | | | | | | |
| Temperature (° C.) | 49 | — | 47 | 55 | 55 | 55 | 55 | 55 |
| Average roundness of core particles | 0.915 | — | 0.912 | 0.931 | 0.933 | 0.932 | 0.941 | 0.943 |

TABLE 4

| | Comparative examples | | | | | |
|---|---|---|---|---|---|---|
| | 1 | 2 | 3 | 4 | 5 | 6 |
| Types of polyester-resin fine particles | A | A | A | A | A | A |
| Amount of aqueous solution of SDS | 48 | 48 | 48 | 48 | 48 | 48 |
| Aggregation conditions | | | | | | |
| pH | 7.45 | 7.48 | 7.55 | 7.78 | 7.64 | 7.77 |

TABLE 4-continued

| | Comparative examples | | | | | |
|---|---|---|---|---|---|---|
| | 1 | 2 | 3 | 4 | 5 | 6 |
| Amount of aggregating agent ($MgCl_2$) (g) | 39 | 39 | 39 | 39 | 39 | 39 |
| Temperature (° C.) | 44 | 45 | 45 | 44 | 46 | 44 |
| Average roundness of aggregated particles | 0.899 | 0.909 | 0.901 | 0.893 | 0.903 | 0.902 |

TABLE 4-continued

| | Comparative examples | | | | | |
|---|---|---|---|---|---|---|
| | 1 | 2 | 3 | 4 | 5 | 6 |
| Coalescence conditions | | | | | | |
| Temperature (° C.) | 55 | 55 | 55 | 55 | 55 | 55 |
| Average roundness of core particles | 0.929 | 0.931 | 0.937 | 0.932 | 0.941 | 0.937 |

TABLE 5

| | Examples | | | | | | | |
|---|---|---|---|---|---|---|---|---|
| | 1 | 2 | 3 | 4 | 5 | 6 | 7 | 8 |
| Types of acrylic-resin fine particles | A | B | C | A | D | E | A | A |
| Aqueous dispersion (2) (at mixing step) | | | | | | | | |
| Temperature (° C.) | 55 | 55 | 55 | 58 | 55 | 55 | 55 | 55 |
| pH | 4.47 | 4.37 | 4.35 | 4.32 | 4.29 | 4.32 | 4.19 | 4.27 |
| Aqueous dispersion (3) (at coating step) | | | | | | | | |
| Temperature (° C.) | 60 | 60 | 60 | 60 | 60 | 60 | 60 | 60 |
| pH | 7.57 | 7.23 | 7.47 | 7.49 | 7.22 | 7.29 | 7.58 | 7.45 |
| Aqueous dispersion (4) (at film-forming step) | | | | | | | | |
| Temperature (° C.) | 69 | 67 | 66 | 69 | 71 | 66 | 69 | 69 |
| pH | 3.12 | 3.24 | 3.46 | 3.35 | 3.26 | 3.41 | 3.15 | 3.45 |

TABLE 6

| | Examples | | | | | | | |
|---|---|---|---|---|---|---|---|---|
| | 9 | 10 | 11 | 12 | 13 | 14 | 15 | 16 |
| Types of acrylic-resin fine particles | A | A | A | A | A | A | A | A |
| Aqueous dispersion (2) (at mixing step) | | | | | | | | |
| Temperature (° C.) | 49 | 59 | 47 | 55 | 55 | 55 | 55 | 55 |
| pH | 4.32 | 4.57 | 4.45 | 4.98 | 4.29 | 4.46 | 4.54 | 4.61 |
| Aqueous dispersion (3) (at coating step) | | | | | | | | |
| Temperature (° C.) | 60 | 60 | 60 | 60 | 60 | 60 | 60 | 60 |
| pH | 7.59 | 7.58 | 7.41 | 7.34 | 9.76 | 6.04 | 7.52 | 7.71 |

TABLE 6-continued

| | Examples | | | | | | | |
|---|---|---|---|---|---|---|---|---|
| | 9 | 10 | 11 | 12 | 13 | 14 | 15 | 16 |
| Aqueous dispersion (4) (at film-forming step) | | | | | | | | |
| Temperature (° C.) | 69 | 69 | 69 | 69 | 69 | 69 | 69 | 73 |
| pH | 3.46 | 3.55 | 3.48 | 3.13 | 3.87 | 2.97 | 4.98 | 3.56 |

TABLE 7

| | Comparative examples | | | | | |
|---|---|---|---|---|---|---|
| | 1 | 2 | 3 | 4 | 5 | 6 |
| Types of acrylic-resin fine particles | F | G | A | A | A | A |
| Aqueous dispersion (2) (at mixing step) | | | | | | |
| Temperature (° C.) | 55 | 55 | 55 | 55 | 55 | 55 |
| pH | 4.23 | 4.34 | 5.07 | 4.11 | 4.22 | 4.36 |
| Aqueous dispersion (3) (at coating step) | | | | | | |
| Temperature (° C.) | 60 | 60 | 60 | 60 | 60 | 60 |
| pH | 7.33 | 7.39 | 7.83 | 5.76 | 10.5 | 7.66 |
| Aqueous dispersion (4) (at film-forming step) | | | | | | |
| Temperature (° C.) | 70 | 64 | 69 | 69 | 69 | 69 |
| pH | 3.40 | 3.46 | 3.89 | 2.88 | 4.24 | 5.12 |

Evaluation 1

For the toners obtained through examples 1 to 16 and comparative examples 1 to 6, heat-resistant storage stability was evaluated by the following method. The evaluation results for the heat-resistant storage stability of the toners of examples 1 to 16 and comparative examples 1 to 6 are shown in tables 8 to 10.

Method for Evaluation of Heat-Resistant Storage Stability 3 g of toner was weighed in a plastic container having a volume of 20 mL, left standing for 3 hours in a thermostat set at 60° C., and then left standing in an environment of 25° C. and 65% RH for 30 minutes to obtain a toner for evaluation of its heat-resistant storage stability. Thereafter, screens having openings of 105 μm, 63 μm, and 45 μm were stacked in this order, the toner for evaluation of heat-resistant storage stability was placed on the screen having the opening of 105 μm, and screening was performed at vibration scale 5 for 30 minutes by using a powder tester (manufactured by Hosokawa Micron Ltd.) with the screens set therein. After screening, the mass ($T_1$ (g)) of the toner remaining on the screen having an opening of 105 μm, the mass ($T_2$ (g)) of the toner remaining on the screen having an opening of 63 μm, and the mass ($T_3$ (g)) of the toner remaining on the screen having an opening of 45 μm were each weighed, and the degree of agglomeration of the toner was calculated from the following equations.

$$T_1/3\times100=C_1$$

$$T_2/3\times100\times3/5=C_2$$

$$T_3/3\times100\times1/5=C_3$$

Degree of agglomeration (%) of toner$=C_1+C_2+C_3$

The heat-resistant storage stability was evaluated on the basis of the criteria described below. Samples rated "Good" or "Neutral" were considered as passing, and samples rated "Bad" were considered as failing.

"Good": the degree of agglomeration of the toner is less than 2%;

"Neutral": the degree of agglomeration of the toner is 2% or more and less than 15%; and "Bad": the degree of agglomeration of the toner is 15% or more.

Evaluation 2

The toners obtained through examples 1 to 16 and comparative examples 1 to 6 were used to evaluate the initial image defects, chargeability, image fogging, and adhesion-onto-member by the following methods. A color multi-functional peripheral (TASKalfa 550ci (manufactured by KYOCERA MITA Corporation)) was used for evaluations of initial image defects, chargeability, image fogging, and adhesion-onto-member. Plain paper was used as the recording medium. Evaluations of initial image defects, chargeability, and image fogging and adhesion-onto-member were performed by using two-component developers prepared by the following method. Evaluation results for the toners of examples 1 to 16 and comparative examples 1 to 6 are shown in tables 8 to 10.

Preparation Example 6

Preparation of Carrier 30 g of a polyamide-imide resin was diluted with 2 L of water to obtain a diluted liquid. 120 g of a tetrafluoroethylene/hexafluoropropylene copolymer (FEP) was dispersed in the diluted liquid obtained, followed by further dispersing of 3 g of silicon dioxide to obtain a coating layer-forming liquid. The coating layer-forming liquid and 10 kg of Non-Coat Ferrite Carrier EF-35B (manufactured by Powdertech Co., Ltd., average particle diameter 35 μm) were introduced into a fluid-bed coating device to form a coating layer of a resin on Non-Coat Ferrite Carrier. Thereafter, baking was performed at 250° C. for 1 hour to obtain a carrier.

(Mixing of Toner and Carrier)

The carrier obtained and the respective toners of examples 1 to 16 and comparative examples 1 to 6 were mixed so that the toner density in a two-component developer was 10% by mass, thereby preparing the two-component developers.

Method for Evaluation of Initial Image Defects

An image pattern was formed by using a color multi-functional peripheral. The image pattern obtained was visually observed to check the presence/absence of color spot and fogging. Initial image defects were evaluated on the basis of the criteria described below.

Good: neither color spot nor fogging was observed on the image; and

Bad: at least one of color spot and fogging was observed on the image.

Method for Evaluation of Chargeability and Image Fogging 5,000 sheets of character patterns were continuously formed on a recording medium at a coverage rate of 2% in an environment of 20° C. and 65% RH by using a color multi-function peripheral. Thereafter, 1,000 sheets of patch patterns were continuously formed on the recording medium at a coverage rate of 50%.

(Evaluation of Chargeability)

The charge value ($Q_1$) of the toner after continuous formation of 5,000 sheets of character patterns and the charge value ($Q_2$) of the toner after continuous formation of 1,000 sheets of patch patterns were measured with a charge value-measuring device, and the amount of change in the charge value ($|Q_2-Q_1|$) was determined. Here, the charge values were measured by using a suction-type charged amount meter (210HS-2A, by Trek Co.). Chargeability was evaluated on the basis of the criteria described below. Samples rated "Good" or "Neutral" were considered as passing.

Good: $|Q_2-Q_1|$ is less than 2 μC/g;

Neutral: $|Q_2-Q_1|$ is 2 μC/g or more less than 5 μC/g; and

Bad: $|Q_2-Q_1|$ is 5 μC/g or more.

(Evaluation of Image Fogging)

The image density in the recording medium before image output was subtracted from the image density of a blank part of a patch pattern further formed on the recording medium after continuous formation of 1,000 sheets of patch patterns, and the value thus obtained was defined as the fogging density. The image densities were measured by using a Gretag-Macbeth Spectroeye (by GretagMacbeth Co.). Image fogging was evaluated on the basis of the criteria described below. Samples rated "Good" or "Neutral" were considered as passing.

Good: the fogging density is less than 0.004;

Neutral: the fogging density is 0.004 or more and less than 0.010; and

Bad: the fogging density is 0.010 or more.

Method for Evaluation of Adhesion-onto-Member 10,000 sheets of line patterns were continuously formed on a recording medium at a coverage rate of 20% in an environment of 32.5° C. and 80% RH by using a color multi-functional peripheral. Thereafter, the presence/absence of adhesion of toner components onto the developing sleeve and/or the photoconductor drum and associated degradation of image quality were observed visually. Adhesion-onto-member was evaluated on the basis of the criteria described below. Samples rated "Good" or "Neutral" were considered as passing.

Good: neither degradation of image quality nor adhesion of toner components onto a member was observed;

Neutral: degradation of image quality was observed, but adhesion of toner components onto a member was not observed; and Bad: both degradation of image quality and adhesion of toner components onto a member were observed.

TABLE 8

| | Examples | | | | | | | |
|---|---|---|---|---|---|---|---|---|
| | 1 | 2 | 3 | 4 | 5 | 6 | 7 | 8 |
| Types of polyester-resin fine particles | A | A | A | B | A | A | A | A |
| Types of acrylic-resin fine particles | A | B | C | A | D | E | A | A |

TABLE 8-continued

| | Examples | | | | | | | |
|---|---|---|---|---|---|---|---|---|
| | 1 | 2 | 3 | 4 | 5 | 6 | 7 | 8 |
| Copolymerization ratio of quaternary ammonium salt (mol %) | 10 | 15 | 10 | 10 | 5 | 30 | 10 | 10 |
| Production conditions of core-particles | | | | | | | | |
| Temperature of aggregation (° C.) | 44 | 44 | 45 | 53 | 45 | 44 | 55 | 38 |
| Temperature of coalescence (° C.) | 55 | 55 | 55 | 58 | 55 | 55 | — | 55 |
| Production conditions of shell layers | | | | | | | | |
| pH of the aqueous dispersion at mixing step | 4.47 | 4.37 | 4.35 | 4.32 | 4.29 | 4.32 | 4.19 | 4.27 |
| pH of the aqueous dispersion at coating step | 7.57 | 7.23 | 7.47 | 7.49 | 7.22 | 7.29 | 7.58 | 7.45 |
| pH of the aqueous dispersion at film-forming step | 3.12 | 3.24 | 3.46 | 3.35 | 3.26 | 3.41 | 3.15 | 3.45 |
| Evaluation | | | | | | | | |
| Heat-resistant storage stability | Good | Good | Good | Good | Good | Good | Good | Good |
| Initial image defects | Good | Good | Good | Good | Good | Good | Good | Good |
| Chargeability | Good | Good | Good | Good | Good | Good | Good | Good |
| Image fogging | Good | Good | Good | Good | Good | Good | Good | Good |
| Adhesion-onto-member | Good | Good | Good | Good | Good | Good | Good | Good |

TABLE 9

| | Examples | | | | | | | |
|---|---|---|---|---|---|---|---|---|
| | 9 | 10 | 11 | 12 | 13 | 14 | 15 | 16 |
| Types of polyester-resin fine particles | A | A | A | A | A | A | A | A |
| Types of acrylic-resin fine particles | A | A | A | A | A | A | A | A |
| Copolymerization ratio of quaternary ammonium salt (mol %) | 10 | 10 | 10 | 10 | 10 | 10 | 10 | 10 |
| Production conditions of core-particles | | | | | | | | |
| Temperature of aggregation (° C.) | 44 | 59 | 44 | 44 | 45 | 44 | 44 | 45 |
| Temperature of coalescence (° C.) | 49 | — | 47 | 55 | 55 | 55 | 55 | 55 |
| Production conditions of shell layers | | | | | | | | |
| pH of the aqueous dispersion at mixing step | 4.32 | 4.57 | 4.45 | 4.98 | 4.29 | 4.46 | 4.54 | 4.61 |
| pH of the aqueous dispersion at coating step | 7.59 | 7.58 | 7.41 | 7.34 | 9.76 | 6.04 | 7.52 | 7.71 |
| pH of the aqueous dispersion at film-forming step | 3.46 | 3.55 | 3.48 | 3.13 | 3.87 | 2.97 | 4.98 | 3.56 |

TABLE 9-continued

| | Examples | | | | | | | |
|---|---|---|---|---|---|---|---|---|
| | 9 | 10 | 11 | 12 | 13 | 14 | 15 | 16 |
| Evaluation | | | | | | | | |
| Heat-resistant storage stability | Good | Neutral | Neutral | Good | Good | Good | Good | Good |
| Initial image defects | Good | Good | Good | Good | Good | Good | Good | Good |
| Chargeability | Good | Good | Neutral | Good | Good | Good | Good | Good |
| Image fogging | Good | Good | Neutral | Good | Good | Good | Good | Good |
| Adhesion-onto-member | Good | Neutral | Neutral | Good | Good | Good | Good | Good |

TABLE 10

| | Comparative examples | | | | | |
|---|---|---|---|---|---|---|
| | 1 | 2 | 3 | 4 | 5 | 6 |
| Types of polyester-resin fine particles | A | A | A | A | A | A |
| Types of acrylic-resin fine particles | F | G | A | A | A | A |
| Copolymerization ratio of quaternary ammonium salt (mol %) | 3 | 40 | 10 | 10 | 10 | 10 |
| Production conditions of core-particles | | | | | | |
| Temperature of aggregation (° C.) | 44 | 45 | 45 | 44 | 46 | 44 |
| Temperature of coalescence (° C.) | 55 | 55 | 55 | 55 | 55 | 55 |
| Production conditions of shell layers | | | | | | |
| pH of the aqueous dispersion at mixing step | 4.23 | 4.34 | 5.07 | 4.11 | 4.22 | 4.36 |
| pH of the aqueous dispersion at coating step | 7.33 | 7.39 | 7.83 | 5.76 | 10.5 | 7.66 |
| pH of the aqueous dispersion at film-forming step | 3.40 | 3.46 | 3.89 | 2.88 | 4.24 | 5.12 |
| Evaluation | | | | | | |
| Heat-resistant storage stability | Good | Bad | Bad | Bad | Bad | Bad |
| Initial image defects | Bad | Good | Bad | Bad | Bad | Good |
| Chargeability | Bad | Bad | Good | Bad | Bad | Good |
| Image fogging | Bad | Bad | Good | Bad | Bad | Good |
| Adhesion-onto-member | Good | Bad | Good | Bad | Bad | Good |

From examples 1 to 16, a toner containing toner particles in which the surfaces of core particles including a binder resin composed of a polyester resin are coated with shell layers, the shell layer is a resin composed of a copolymer of monomers including a monomer having a quaternary ammonium group and a (meth)acrylic monomer, and the molar ratio of units derived from the monomer having a quaternary ammonium group in the copolymer is 5 mol % or more and 35 mol % or less has excellent heat-resistant storage stability. It is apparent that when an image is formed by using the above-described toner, the occurrence of an image failure in the formed image such as color spot or fogging and degradation of the quality of the formed image due to adhesion of toner components onto the developing sleeve or photoconductor drum can be suppressed, and even if toner particles are stirred in the developing unit for a long time, toner particles can be charged at a desired charge value, so that fogging in the formed image can be suppressed.

From comparative example 1, it is apparent that when an image is formed by using a toner containing toner particles having shell layers including a resin in which the molar ratio of units derived from a monomer having a quaternary ammonium group is too low, an image failure such as color spot or fogging tends to occur, and if toner particles are stirred in the developing unit for a long time, it is hard to charge toner particles at a desired charge value, so that it is difficult to suppress fogging in the formed image.

From comparative example 2, a toner containing toner particles having shell layers including a resin in which the molar ratio of units derived from a monomer having a quaternary ammonium group is too high has poor storage stability. It is apparent that when an image is formed by using such a toner, it is difficult to suppress degradation of the quality of the formed image due to adhesion of toner components onto the developing sleeve or photoconductor drum, and if toner particles are stirred in the developing unit for a long time, it is hard to charge toner particles at a desired charge value, so that it is difficult to suppress fogging in the formed image.

From comparative example 3, it is apparent that when toner particles are produced by mixing aqueous dispersion (1) and aqueous dispersion (2) under conditions such that the pH of aqueous dispersion (1) is above 5, it is difficult to obtain a toner containing toner particles with excellent storage stability which can suppress an image failure such as color spot or fogging in the formed image.

From comparative examples 4 and 5, it is apparent that when toner particles are produced by coating core particles with resin fine particles under conditions such that the pH of aqueous dispersion (3) falls out of the range from 6 to 10, it is difficult to obtain a toner containing toner particles which can suppress occurrence of an image failure such as color spot or fogging in the formed image and degradation of quality of the formed image due to adhesion of toner components onto the developing sleeve or the photoconductor drum, and if toner particles are stirred in the developing unit for a long time, toner particles can be charged at a desired charge value, so that fogging in the formed image can be suppressed.

From comparative example 6, it is apparent that when toner particles are produced by performing film-forming step (IV) under conditions such that the pH of aqueous dispersion (4) is too high, it is difficult to obtain a toner with excellent storage stability.

The invention claimed is:

1. A method for producing a toner for electrostatic-charge image development including toner particles in which the surfaces of core particles including a binder resin composed of a polyester resin are coated with shell layers, the method including steps (I) to (IV):

(I): a core particle dispersion-preparing step of obtaining an aqueous dispersion (1) containing core particles including a binder resin composed of a polyester resin, where aqueous dispersion (1) contains an anionic or nonionic dispersant;

(II): a mixing step of mixing aqueous dispersion (1) adjusted to a pH of 5 or less and an aqueous dispersion (2) containing resin fine particles to obtain an aqueous dispersion (3) containing the core particles and the resin fine particles;

(III): a coating step of adjusting the pH of aqueous dispersion (3) to 6 or more and 10 or less, followed by heating of aqueous dispersion (3) to coat the surfaces of the core particles with the resin fine particles, thereby obtaining an aqueous dispersion (4) containing core particles coated with the resin fine particles; and (IV): a film-forming step of adjusting the pH of aqueous dispersion (4) to 5 or less, followed by heating aqueous dispersion (4) to transform the resin fine particles, with which the surfaces of the core particles are coated, into a film, wherein the shell layer is a resin composed of a copolymer of monomers including a monomer having a quaternary ammonium group and a (meth)acrylic monomer, and the molar ratio of units derived from the monomer having a quaternary ammonium group in the copolymer is 5 mol % or more and 35 mol % or less.

2. The method for producing a toner for electrostatic-charge image development according to claim 1, wherein step (I) includes steps (i) and (ii):

(i): a step of obtaining an aqueous dispersion (A) containing fine particles including the binder resin, followed by aggregation of the fine particles in the presence of an aggregating agent to obtain an aqueous dispersion (B) containing aggregated particles including a binder resin; and (ii): a step of heating aqueous dispersion (B) to obtain aqueous dispersion (1) containing the core particles.

3. The method for producing a toner for electrostatic-charge image development according to claim 2, wherein aggregation of the fine particles is performed at a temperature equal to or above the glass transition point ($Tg_1$) of the binder resin and below $Tg_1$+10° C. in step (i), and aqueous dispersion (B) is heated to a temperature equal to or above $Tg_1$+10° C. in step (ii).

4. The method for producing a toner for electrostatic-charge image development according to claim 1, wherein mixing of aqueous dispersion (1) adjusted to a pH of 5 or less and aqueous dispersion (2) is performed at a temperature below the glass transition point ($Tg_2$) of the resin fine particles+10° C. in step (II), aqueous dispersion (3) is heated at a temperature equal to or above $Tg_2$−10° C. and below $Tg_2$ in step (III), and aqueous dispersion (4) is heated at a temperature no lower than $Tg_2$ and no higher than $Tg_2$+5° C. in step (IV).

* * * * *